US012514316B2

(12) United States Patent
Geisinsky

(10) Patent No.: US 12,514,316 B2
(45) Date of Patent: Jan. 6, 2026

(54) TOPPER HAIRPIECE INTERFACE APPARATUS

(71) Applicant: NG Imports, Inc., Signal Hill, CA (US)

(72) Inventor: Yehudis Geisinsky, Long Beach, CA (US)

(73) Assignee: NG Imports, Inc., Signal Hill, CA (US)

( * ) Notice: Subject to any disclaimer, the term of this patent is extended or adjusted under 35 U.S.C. 154(b) by 0 days.

(21) Appl. No.: 17/559,439

(22) Filed: Dec. 22, 2021

(65) Prior Publication Data

US 2022/0192300 A1 Jun. 23, 2022

Related U.S. Application Data

(60) Provisional application No. 63/129,553, filed on Dec. 22, 2020.

(51) Int. Cl.
*A41G 5/00* (2006.01)

(52) U.S. Cl.
CPC ..... *A41G 5/004* (2013.01)

(58) Field of Classification Search
CPC ..... A41G 5/00; A41G 5/0006; A41G 5/0013; A41G 5/0026; A41G 5/006; A41G 5/0066;

(Continued)

(56) References Cited

U.S. PATENT DOCUMENTS 1,671,415 A 5/1928 Eckert
D365,918 S 1/1996 Izegbu et al.
(Continued)

FOREIGN PATENT DOCUMENTS

CN 303113653 S 2/2015
CN 305106180 S 4/2019
(Continued)

OTHER PUBLICATIONS

Title: Wigrip; URL: https://rhythmwigs.com/wigs/wig-band-wigrip/ ; Accessed date: Feb. 5, 2021.
(Continued)

*Primary Examiner* — Rachel R Steitz
*Assistant Examiner* — Karim Asqiriba
(74) *Attorney, Agent, or Firm* — Lance M. Pritikin

(57) ABSTRACT

Disclosed are exemplary topper hairpiece interface apparatuses for facilitating securement of a topper hairpiece to the head of a wearer. The apparatus may include a hairpiece engagement element and a retention band. The hairpiece engagement element is flexible and has opposing lateral sides, an outboard face and an inboard face. The retention band may be configured to be connected between the lateral sides, is preferably transparent, and may include one or more length-adjustment buckles. The hairpiece engagement element may include one or more fastener engagement members configured to be engaged by a comb-type or clip-type hairpiece fastener of a topper hairpiece. For example, a medial fastener engagement member may be configured to be fasteningly engaged by a medial hairpiece fastener of a topper hairpiece, and a pair of lateral fastener engagement members may each be configured to be fasteningly engaged by a respective lateral hairpiece fastener of the topper hairpiece.

17 Claims, 28 Drawing Sheets

(58) Field of Classification Search
CPC .... A41G 5/0073; A41G 5/004; A41G 5/0046; A41G 5/0053; A41G 5/0093; A41G 3/00; A41G 3/008; A41G 3/0016; A41G 3/0033; A41G 3/0041; A41G 3/005; A41G 3/0058; A45D 8/36; A45D 8/40
See application file for complete search history.

(56) References Cited

U.S. PATENT DOCUMENTS

| | | | | |
|---|---|---|---|---|
| 5,592,957 | A | 1/1997 | Gazerro et al. | |
| D413,710 | S | 9/1999 | De Rugeriis | |
| D494,711 | S | 8/2004 | LeBow | |
| 8,186,361 | B2 | 5/2012 | Hampton | |
| D669,633 | S | 10/2012 | Hedgren | |
| D712,094 | S | 8/2014 | Branson | |
| D742,072 | S | 10/2015 | Dixon-Miller | |
| 9,179,721 | B2 | 11/2015 | Hines et al. | |
| D746,516 | S | 12/2015 | Cardello et al. | |
| D752,815 | S | 3/2016 | Cardello et al. | |
| D873,493 | S | 1/2020 | Geisinsky et al. | |
| D879,382 | S | 3/2020 | Ning | |
| D893,104 | S | 8/2020 | Ning | |
| D895,900 | S | 9/2020 | Ning | |
| 10,881,159 | B2 | 1/2021 | Geisinsky et al. | |
| 10,945,477 | B2 | 3/2021 | Geisinsky et al. | |
| 2002/0189627 | A1* | 12/2002 | Tang | A41G 3/0033 132/53 |
| 2011/0023903 | A1* | 2/2011 | Kezios | A41G 3/005 132/54 |
| 2014/0116456 | A1 | 5/2014 | Palmer-Rogers | |
| 2015/0230590 | A1* | 8/2015 | Livingston | A45D 44/22 132/200 |
| 2019/0104793 | A1* | 4/2019 | Young | A41G 5/006 |
| 2020/0015532 | A1* | 1/2020 | Geisinsky | A41G 3/0016 |
| 2020/0214379 | A1 | 7/2020 | Geisinsky et al. | |
| 2020/0315309 | A1* | 10/2020 | Chang | A45D 8/36 |
| 2022/0142279 | A1* | 5/2022 | Young | A41G 5/0073 |

FOREIGN PATENT DOCUMENTS

| | | | |
|---|---|---|---|
| CN | 305501285 | S | 12/2019 |
| CN | 305506412 | S | 12/2019 |
| CN | 306114724 | S | 10/2020 |
| GB | 4035095 | | 4/2014 |
| GB | 6019169 | | 9/2017 |
| GB | 6019170 | | 9/2017 |
| GB | 6019171 | | 9/2017 |
| GB | 6019173 | | 9/2017 |
| JP | D1088632 | | 8/2000 |
| JP | D1337804 | | 7/2008 |
| JP | D1337806 | | 7/2008 |
| JP | D1337807 | | 7/2008 |
| JP | D1338290 | | 7/2008 |
| JP | D1379926 | | 1/2010 |
| JP | D1391781 | | 6/2010 |
| JP | D1586936 | | 9/2017 |
| KR | 3002983000000 | | 5/2002 |
| KR | 3006686140001 | | 11/2012 |
| KR | 3009413800000 | | 1/2018 |
| KR | 3009413830000 | | 1/2018 |
| KR | 3009413840000 | | 1/2018 |
| KR | 3009417980000 | | 1/2018 |
| WO | DM/094688 | | 11/2016 |

OTHER PUBLICATIONS

Title: Milano collection lace WiGrip velvet comfort wig grip band for lace wigs and frontals with reinforced swiss lace by hairline and part; URL: https://www.mcwigs.com/lacegrip.html ; Accessed date: Feb. 5, 2021.

Title: Transparent lace wig grip headband adjustable wig cap wig making wig holding supplies, hat 5pcs free shipping; URL:https://pl.aliexpress.com/item/4000108829529.html?spm=a2g17.search0303.3.49.1ae43090jeJwhL&ws_ab_test=searchweb0_0,searchweb201602_0,searchweb201603_0,ppcSwitch_0&algo_pvid=d3f08af5-5fca-47bd-b2cb-4564f921c2ce&algo_expid=d3f08af5-5fca-47bd-b2cb-4564f921c2ce-6 ; Accessed date: Feb. 5, 2021.

Title: U Part Wig Caps With Lace Net For Making Wigs With Adjustable Straps; URL: https://in.pinterest.com/pin/630644754049080146/ ; Accessed date: Feb. 5, 2021.

Title: New arrival velvet wig grip wig band with adjustable strap beige colour; URL: https://www.ebay.com/itm/New-arrival-Velvet-Wig-Grip-Wig-Band-with-adjustable-strap-beige-colour-/123953494368 ; Accessed date: Feb. 5, 2021.

Title: GEX wig grip band adjustable wig comfort band headband flexible velvet scarf wig comfort non-slip adjustable fasten new design wig bands with arch extra hold for women (Brown); URL: https://www.ubuy.co.in/search/index/view/product/B07VMCPYBY/s/gex-wig-grip-band-adjustable-wig-comfort-band-headband-flexible-velvet-scarf-wig-comfort-non-slip-adjustable-fasten-new-design-wig-bands-with-arch-extra-hold-for-women-brown/store/store/kk/dp ; Accessed date: Feb. 5, 2021.

* cited by examiner

TOPPER HAIRPIECE INTERFACE APPARATUS

RELATED APPLICATIONS

This application claims the benefit of U.S. Provisional Application No. 63/129,553 filed Dec. 22, 2020, the contents of which are incorporated by this reference in its entirety for all purposes as if fully set forth herein.

TECHNICAL FIELD

The disclosure herein relates generally to wigs and hairpieces. More particularly, the present disclosure relates to devices for facilitating the stable attachment of topper hairpieces to the head of a wearer.

BACKGROUND

Topper hairpieces are designed to blend with the existing hair of the wearer to add localized hair volume, and thus have foundations that generally do not envelope enough of the head of the wearer to adequately secure the topper hairpiece to the head of the wearer. Rather, conventional topper hairpieces typically include other attachment mechanisms such as combs and/or clips for anchoring the hairpiece foundation to portions of the wearer's surrounding or underlying natural hair. Additionally, or in the alternative, conventional topper hairpieces may include a thin plastic material on the underside of the foundation to facilitate gluing or taping the hairpiece directly to the scalp of the wearer at the location where additional hair volume is desired. These conventional approaches to securing the topper hairpiece to the head can cause damage to existing natural hair, or irritation of the scalp. Conventional wig grip bands are deficient for use as an interface between a topper hairpiece and the head of the wearer, in part because portions of these bands present bulk and unsightliness at the rear of the wearer's head where no hairpiece foundation is present to cover up the rear portions of the conventional wig grip band.

SUMMARY

One or more deficiencies of the prior art are solved by way of embodiments of the topper hairpiece interface apparatus in accordance with the present disclosure.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
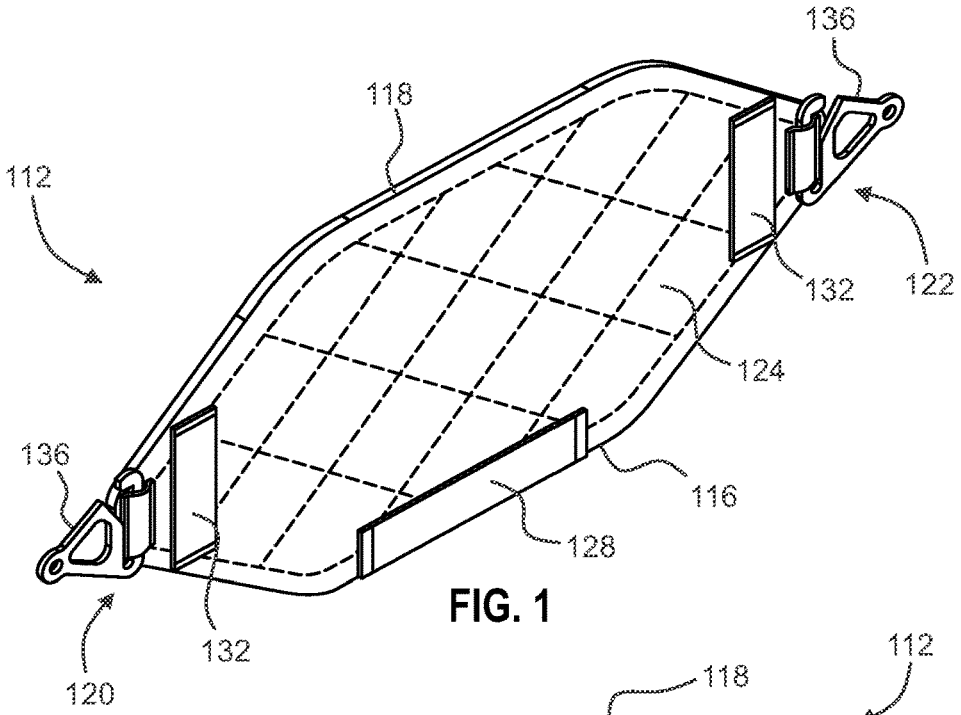
FIG. 1 is a diagrammatic perspective view of one example hairpiece engagement element for a topper hairpiece interface apparatus in accordance with the present disclosure.

Referring now to the drawings, like reference numerals designate identical or corresponding features throughout the several views.

With reference to the several drawings, embodiments of a topper hairpiece interface apparatus are shown generally at 100, and are configured to facilitate securement of a topper hairpiece 102 to the head 106 of a wearer. A typical topper hairpiece 102 will include a foundation 104 and strands of hair affixed to the foundation. The topper hairpiece interface apparatus 100 may preferably comprise at least a hairpiece engagement element 112 and a retention band element 114.

The hairpiece engagement element 112 may be flexible and have a first lateral side 120, a second lateral side 124 opposite thereof, an outboard face 124 and an inboard face 126. The hairpiece engagement element 112 may be comprised of a fabric. For example, the hairpiece engagement element 112 is comprised of a velvet or velour with unidirectional piled fiber to improve friction between the hairpiece engagement element 112 and the wearer's natural hair or scalp.

The retention band element 114 is preferably configured to be connected to the first lateral side 120 and the second lateral side 122 to extend therebetween. In particular preferred embodiments of the apparatus 100, the retention band element 114 is comprised of a transparent material. For example, the retention band element 114 may be a transparent polymer filament. Moreover, the retention band element 114 may be elastic. In certain preferred embodiments of the apparatus 100, the retention band element 114 may include a length-adjustment buckle 144 configured to enable a user to adjust the length of the retention band element 114.

In particular embodiments of the apparatus 100, the retention band element 114 may be connected to the first lateral side 120 and second lateral side 122 by way of a respective pair of band connectors 136 non-destructively removable from the first and second lateral sides. The band connectors 136 may be comprised of a metal.

Figure 3:
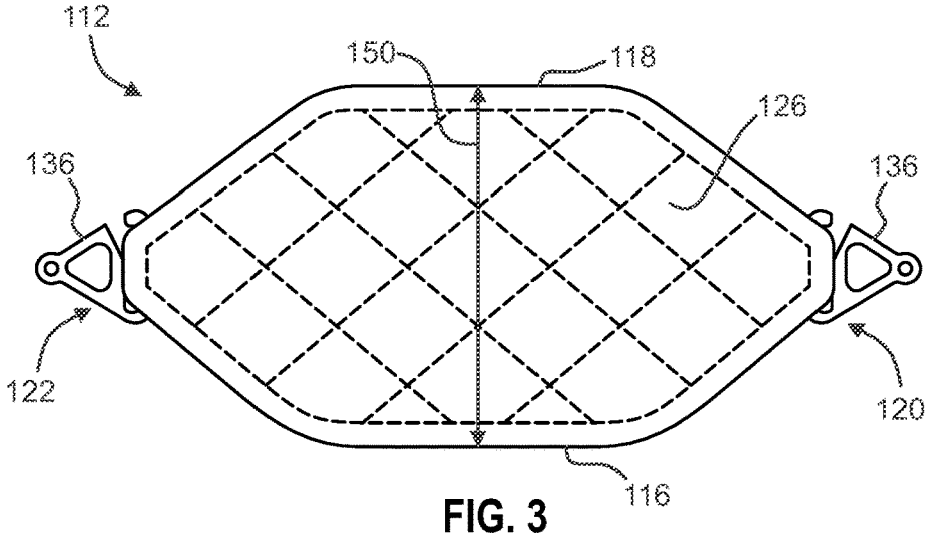
FIG. 3 is a diagrammatic bottom plan view of the example hairpiece engagement element in FIG. 1.
Figure 4:
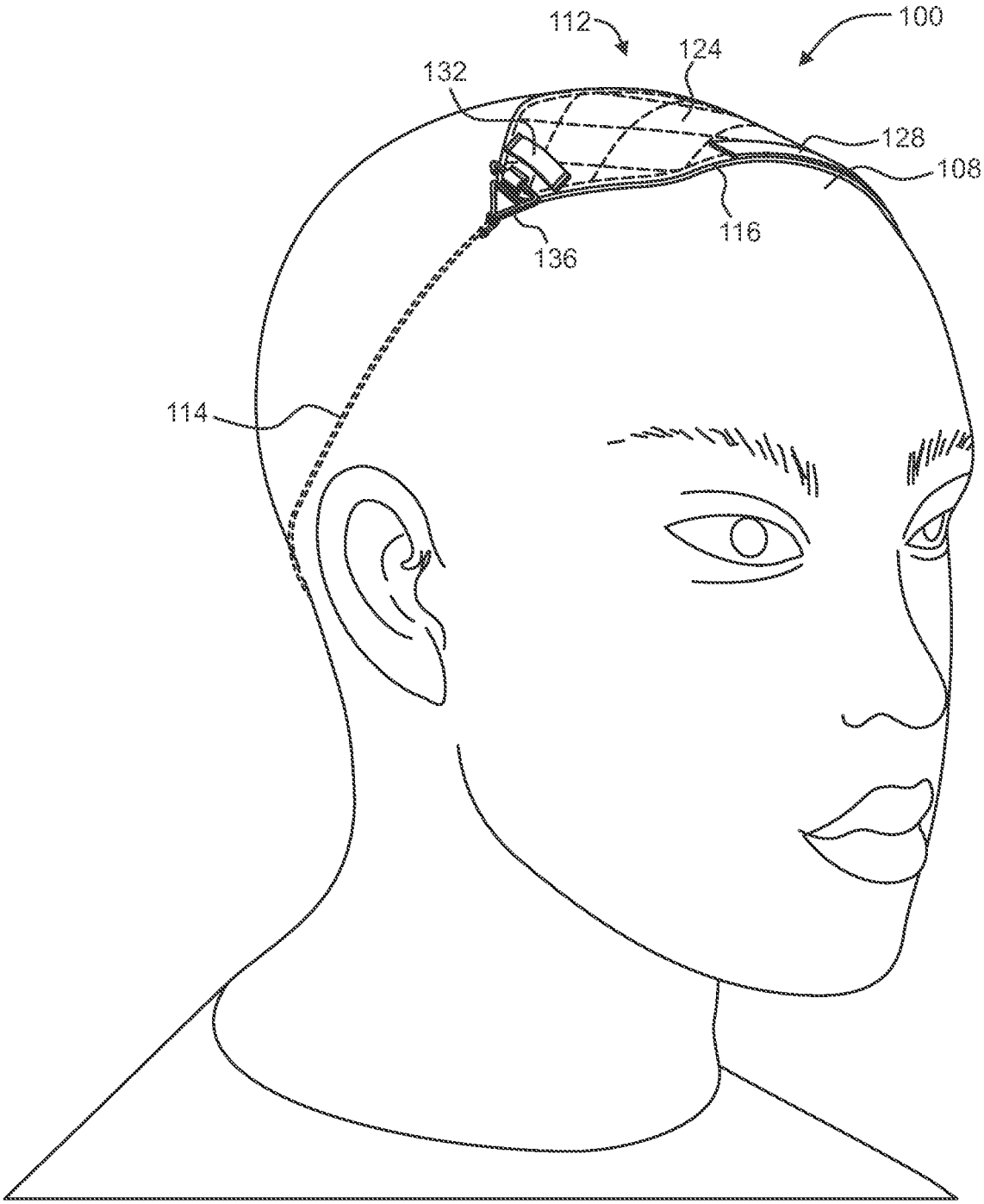
FIG. 4 is a diagrammatic perspective view of an example topper hairpiece interface apparatus comprising the example hairpiece engagement element of FIG. 1, but wherein the apparatus is shown secured to the head of a wearer.
Figure 5:
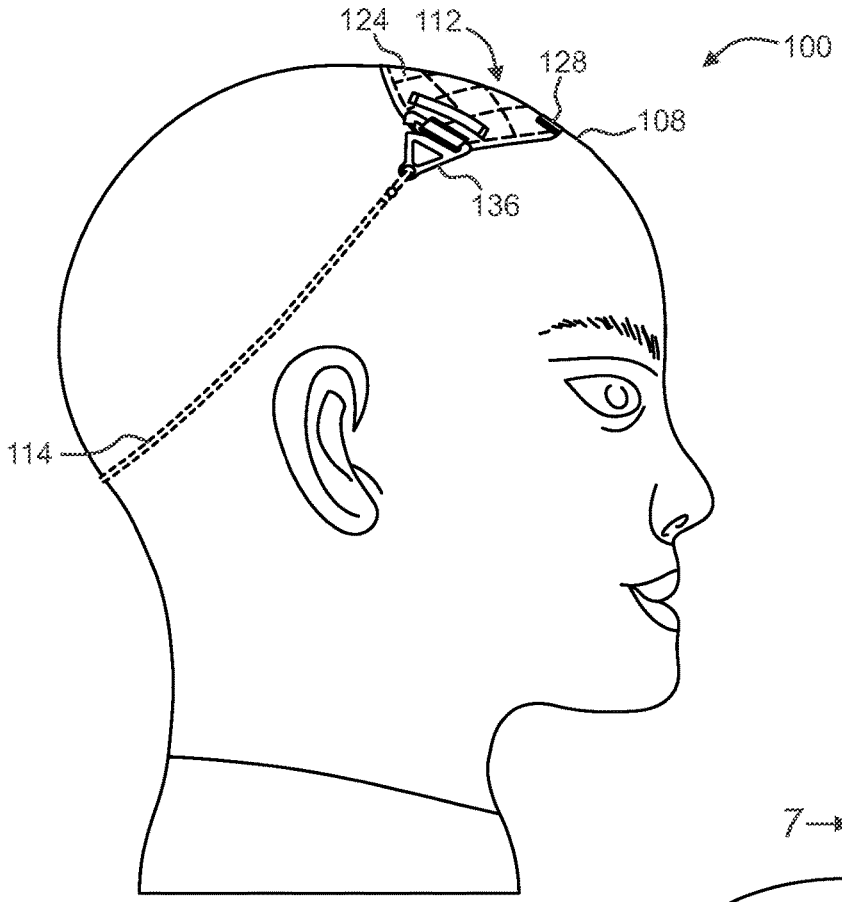
FIG. 5 is a diagrammatic side view of the apparatus and wearer of FIG. 4.
Figure 6:
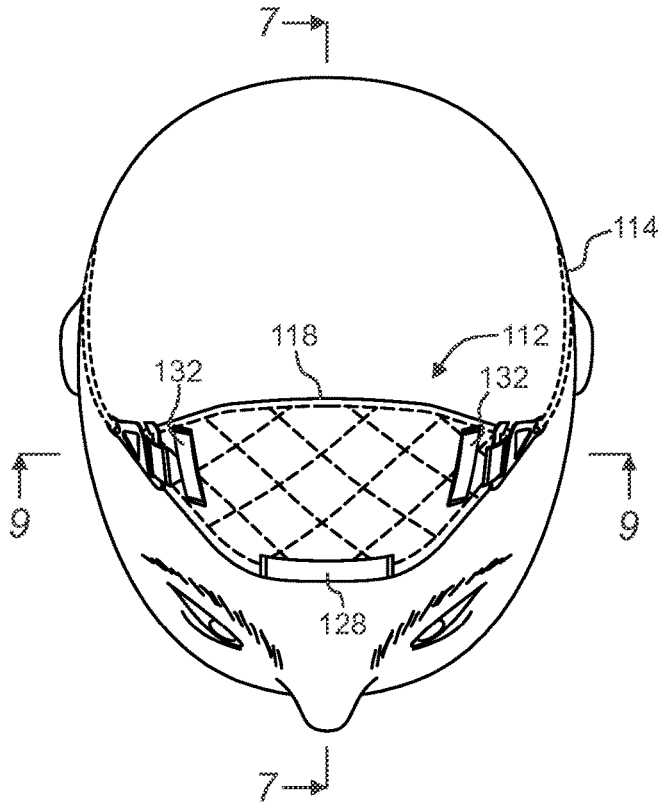
FIG. 6 is a diagrammatic top view of the apparatus and wearer of FIG. 4.

Referring to FIG. 3, in particular embodiments of the apparatus 100, the hairpiece engagement element 112 may include a forward edge 116, a rearward edge 118 opposite thereof and a width 150 defined between the forward edge 116 and the rearward edge 118. As shown in FIG. 3 for example, the width 150 may be greater toward the center of hairpiece engagement element 112 than toward the first lateral side 120 and second lateral side 122.

In certain embodiments of the apparatus 100, the hairpiece engagement element 112 may include at least one fastener engagement member (e.g., 128 and/or 132) configured to be fasteningly engaged by a hairpiece fastener (e.g., 138 and/or 140) of a topper hairpiece 102. The hairpiece fastener may be, for example, a comb-type fastener or a clip-type fastener such as those found on conventional hairpieces.

Figure 2:
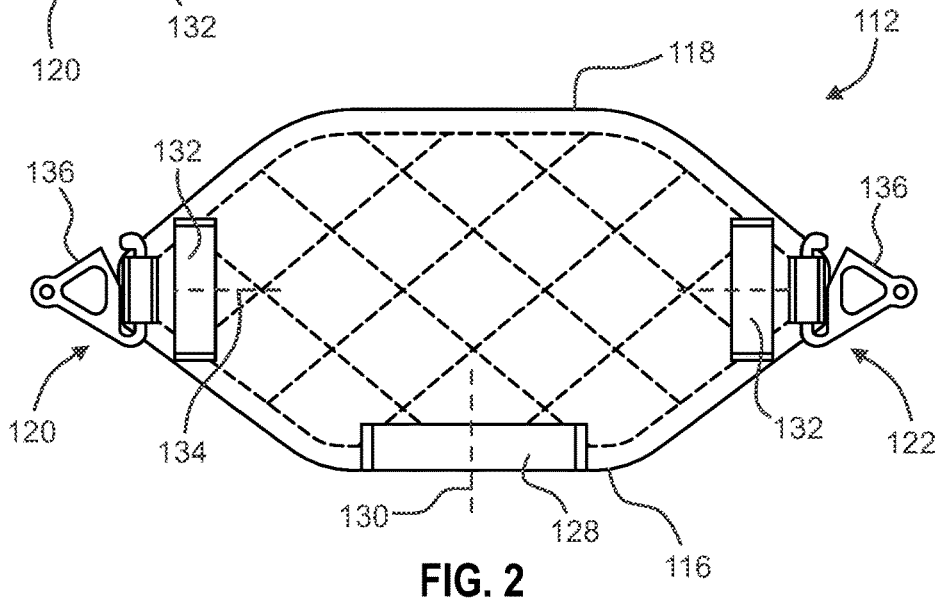
FIG. 2 is a diagrammatic top plan view of the example hairpiece engagement element in FIG. 1.
Figure 7:
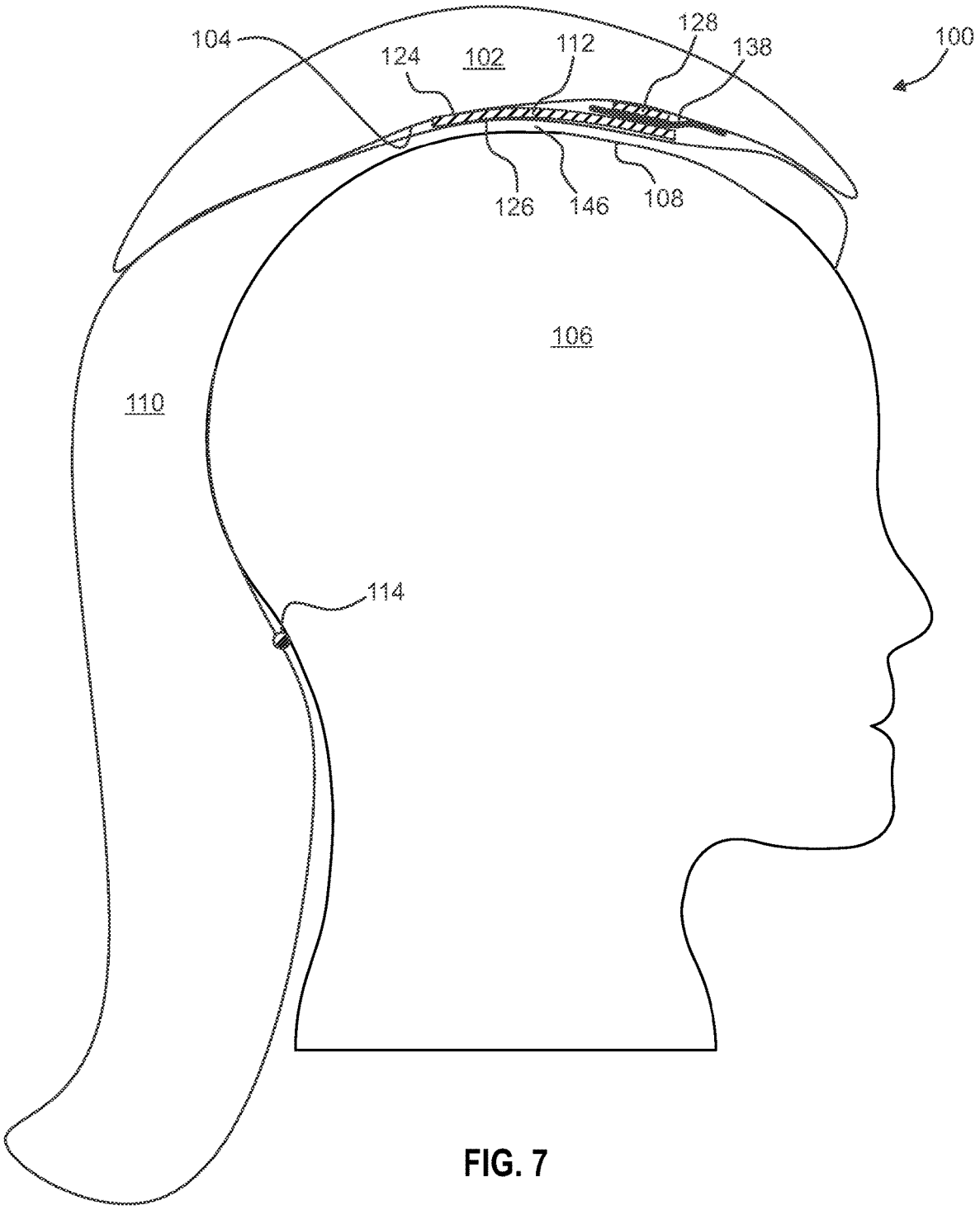
FIG. 7 is a diagrammatic cross-sectional view taken along lines 7-7 in FIG. 6, showing a first method of affixing the topper hairpiece to the hairpiece engagement element, wherein a comb of the hairpiece foundation extends between the medial fastener engagement member and the outboard face of the hairpiece engagement element.
Figure 8:
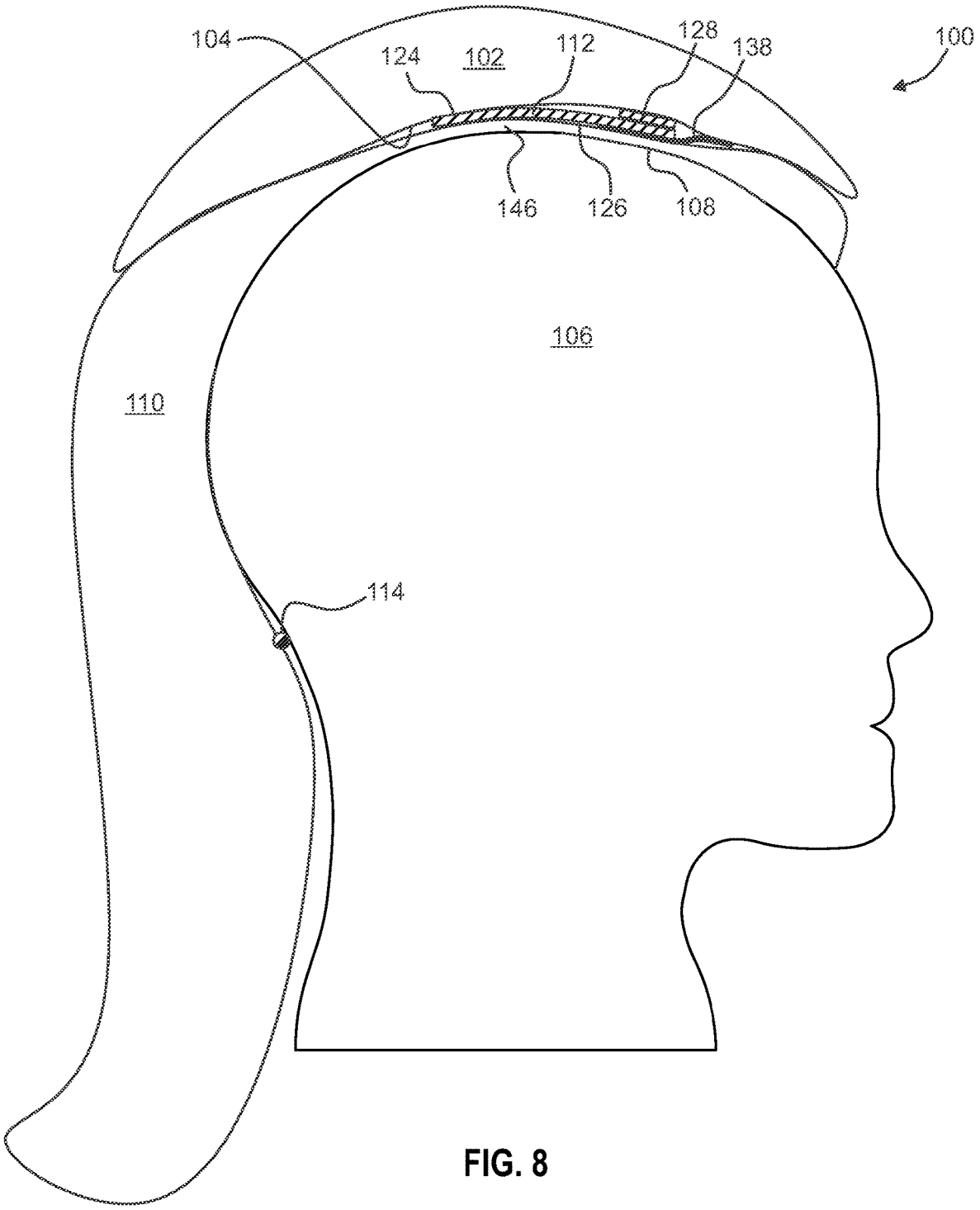
FIG. 8 is a diagrammatic cross-sectional view similar to that of FIG. 7, but showing a second method of affixing the topper hairpiece to the hairpiece engagement element, wherein a comb of the hairpiece foundation extends under the hairpiece engagement element.
Figure 9:
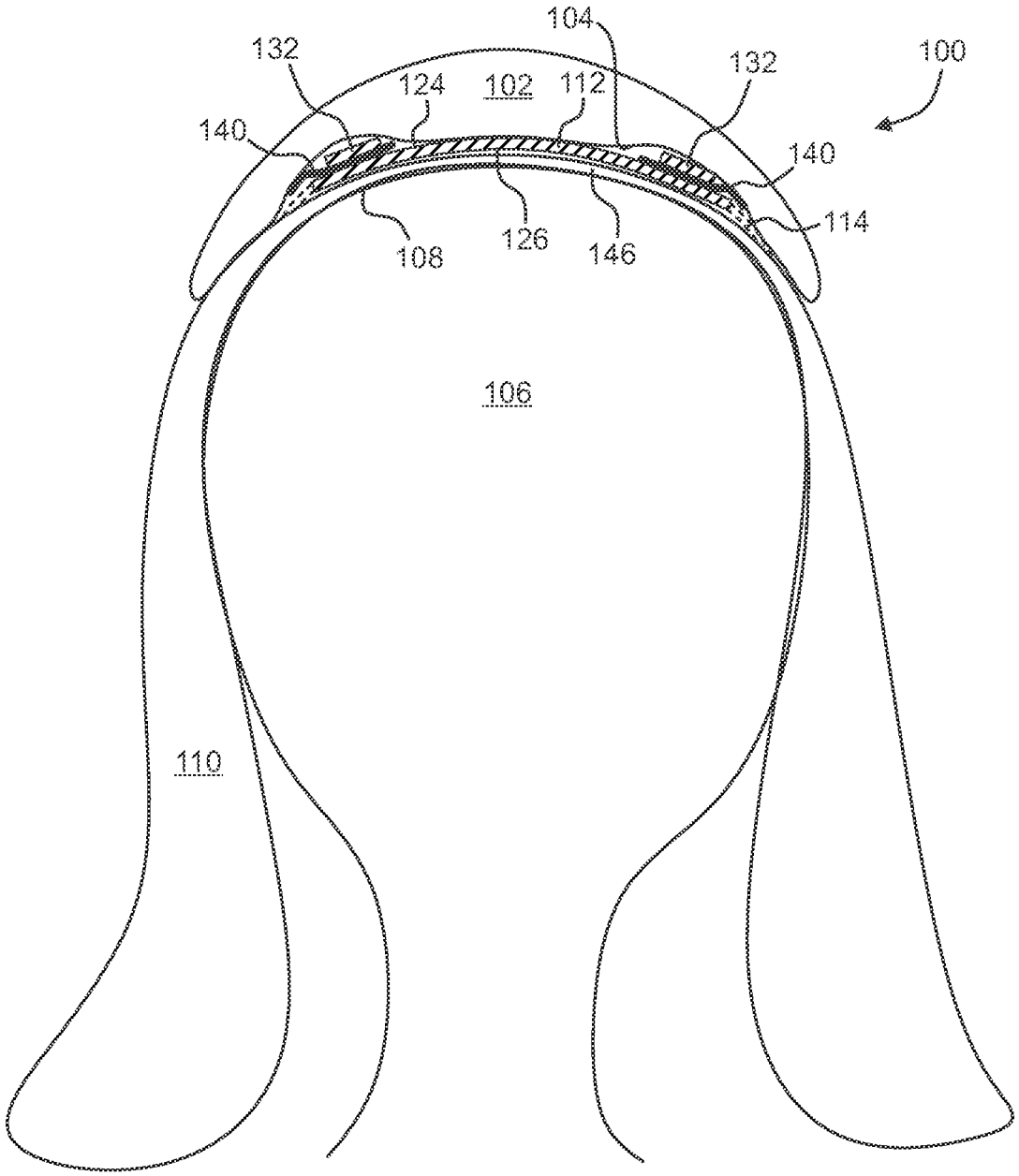
FIG. 9 is a diagrammatic cross-sectional view taken along lines 9-9 in FIG. 6, showing one method of affixing the topper hairpiece to the hairpiece engagement element, wherein a pair of clips of the hairpiece foundation extend between the lateral fastener engagement members and the outboard face of the hairpiece engagement element.
Figure 10:
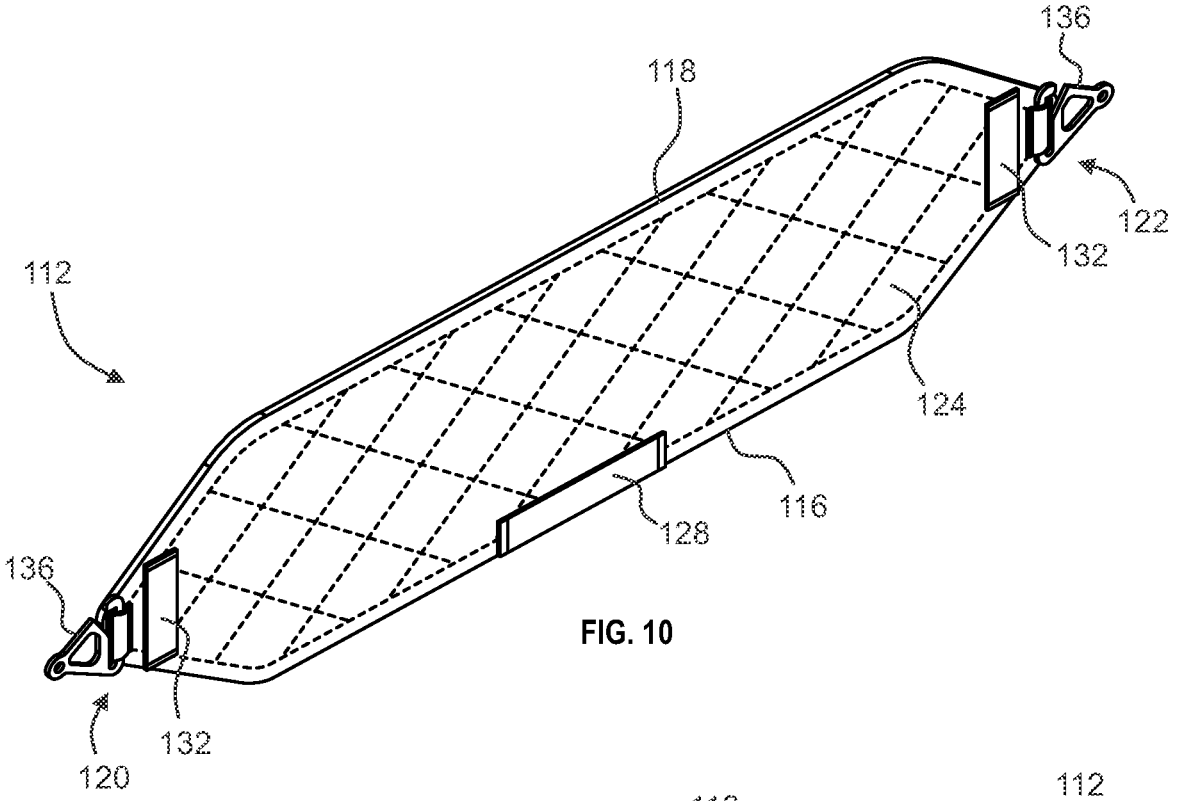
FIG. 10 is a diagrammatic perspective view of a second example hairpiece engagement element for a topper hairpiece interface apparatus in accordance with the present disclosure.
Figure 11:
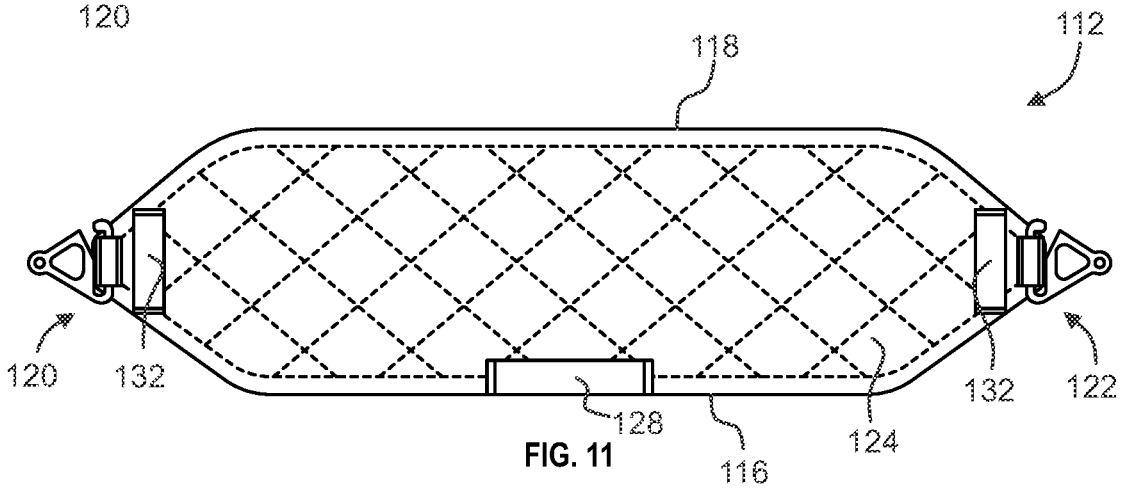
FIG. 11 is a diagrammatic top plan view of the example hairpiece engagement element in FIG. 10.
Figure 12:
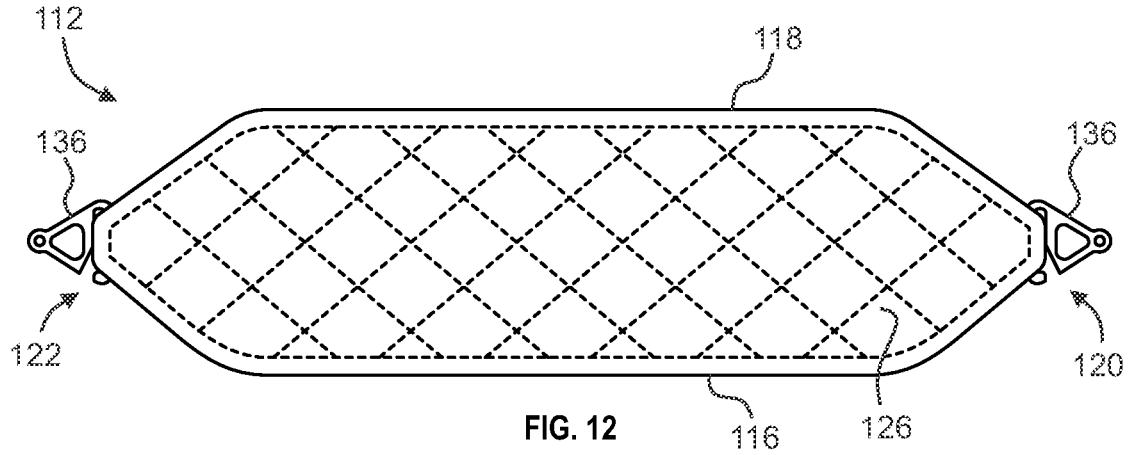
FIG. 12 is a diagrammatic bottom plan view of the example hairpiece engagement element in FIG. 10.
Figure 13:
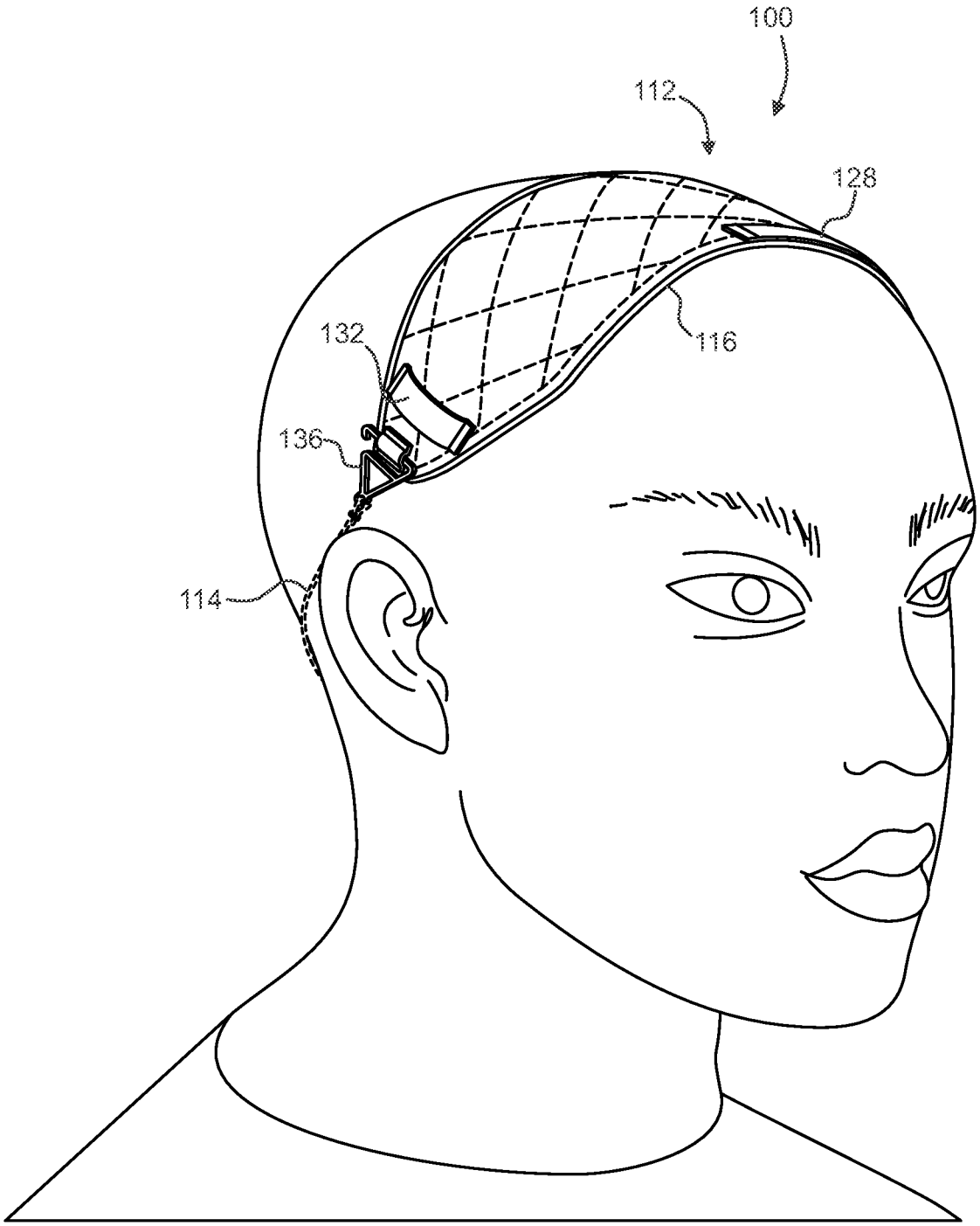
FIG. 13 is a diagrammatic perspective view of an example topper hairpiece interface apparatus comprising the example hairpiece engagement element of FIG. 10, but wherein the apparatus is shown secured to the head of a wearer.
Figure 14:
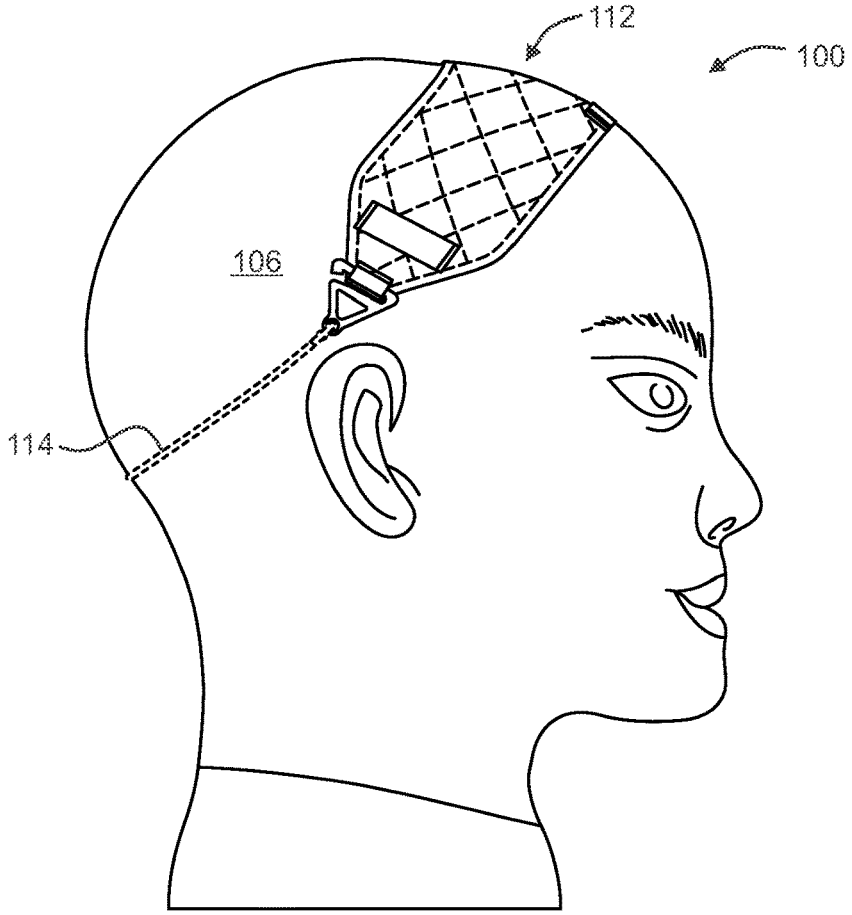
FIG. 14 is a diagrammatic side view of the apparatus and wearer of FIG. 13.
Figure 15:
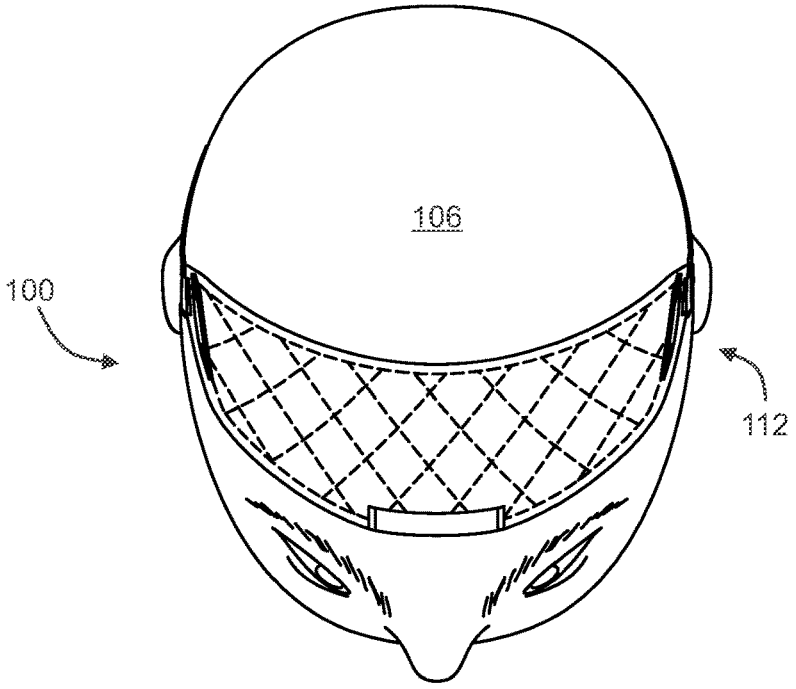
FIG. 15 is a diagrammatic top view of the apparatus and wearer of FIG. 13.
Figure 16:
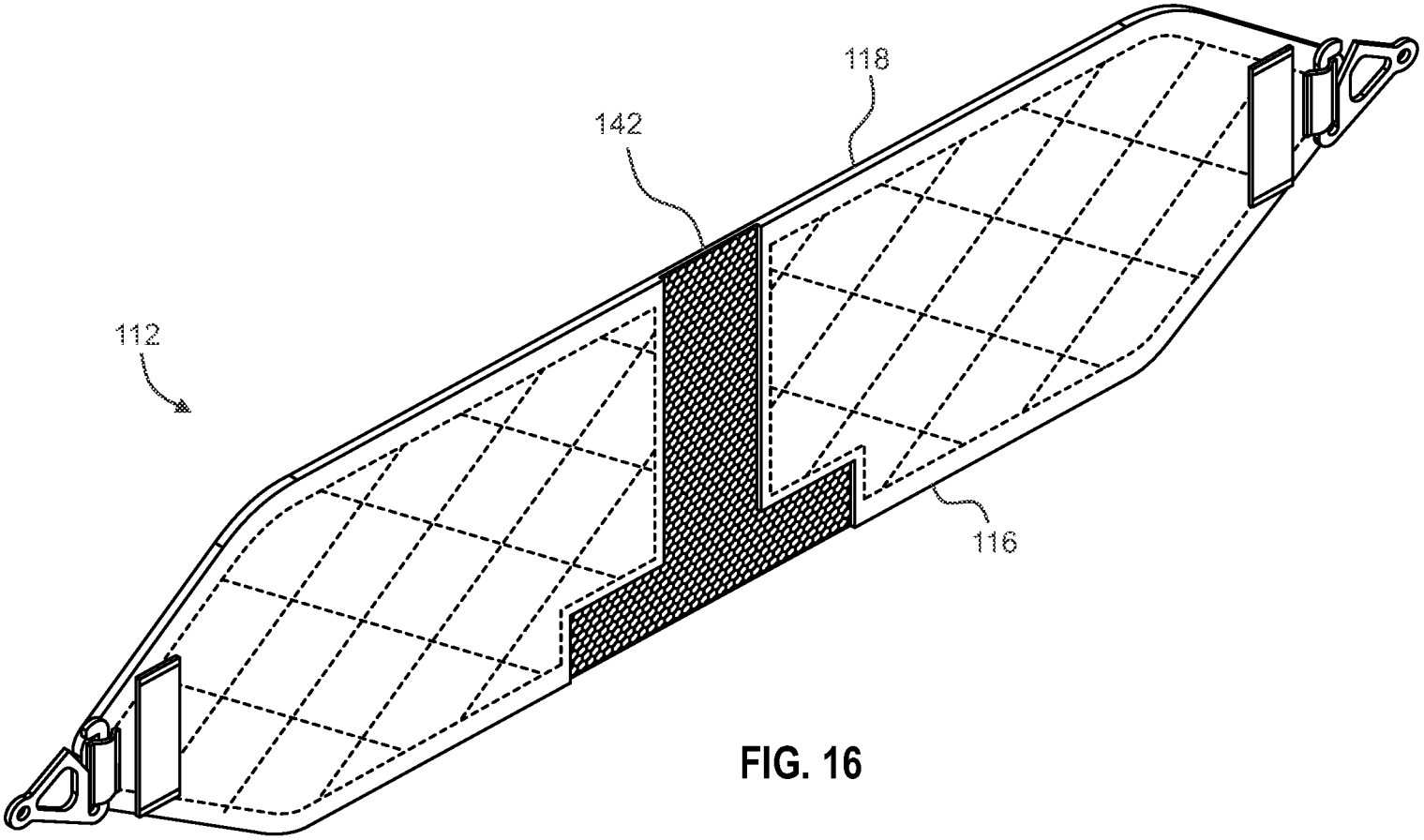
FIG. 16 is a diagrammatic perspective view of a third example hairpiece engagement element for a topper hairpiece interface apparatus in accordance with the present disclosure.
Figure 17:
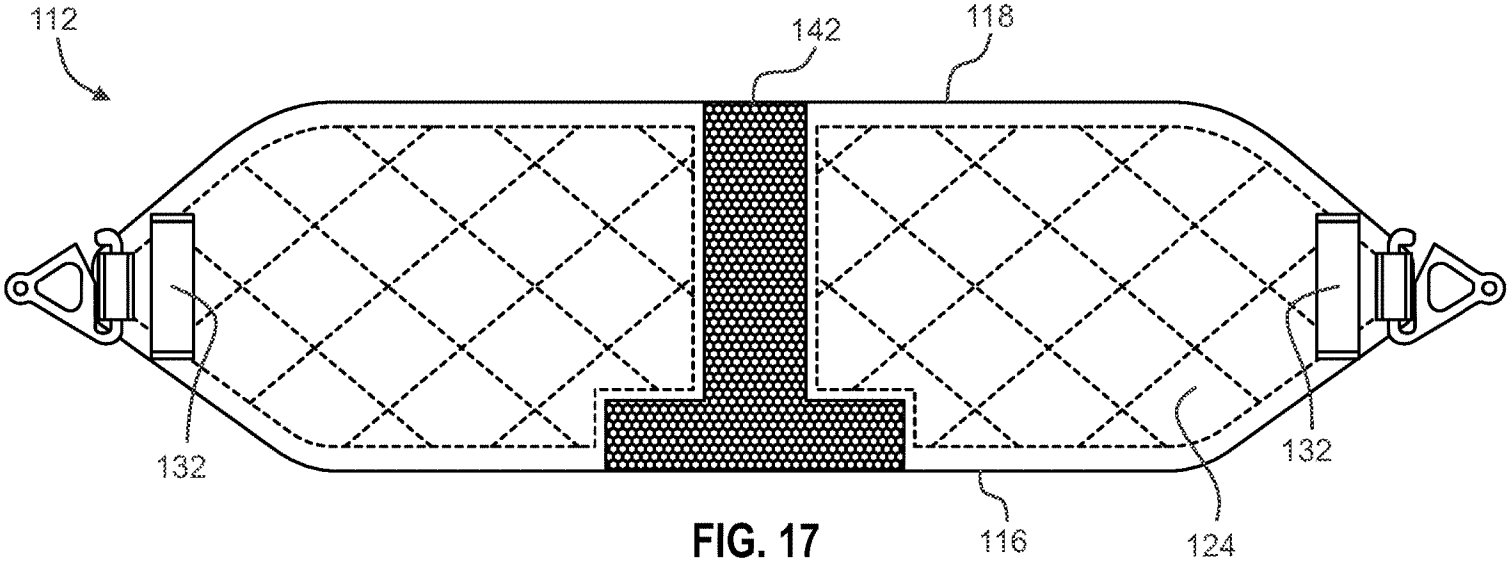
FIG. 17 is a diagrammatic top plan view of the example hairpiece engagement element in FIG. 16.
Figure 18:
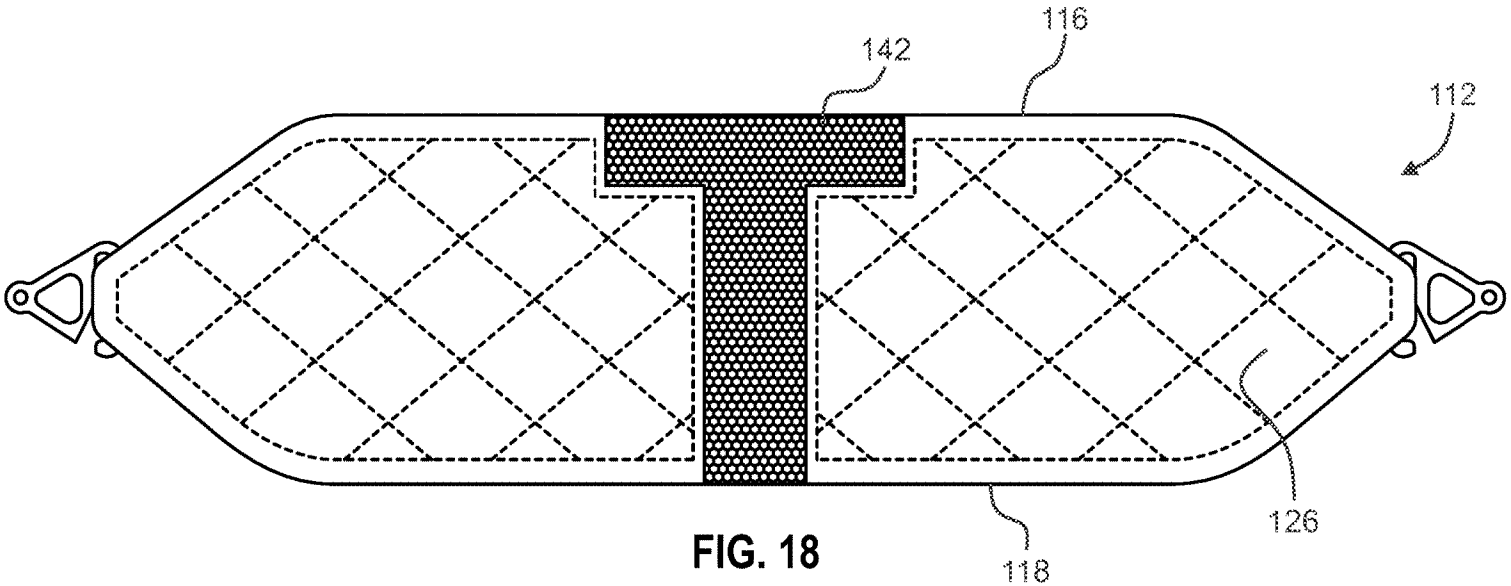
FIG. 18 is a diagrammatic bottom plan view of the example hairpiece engagement element in FIG. 16.
Figure 19:
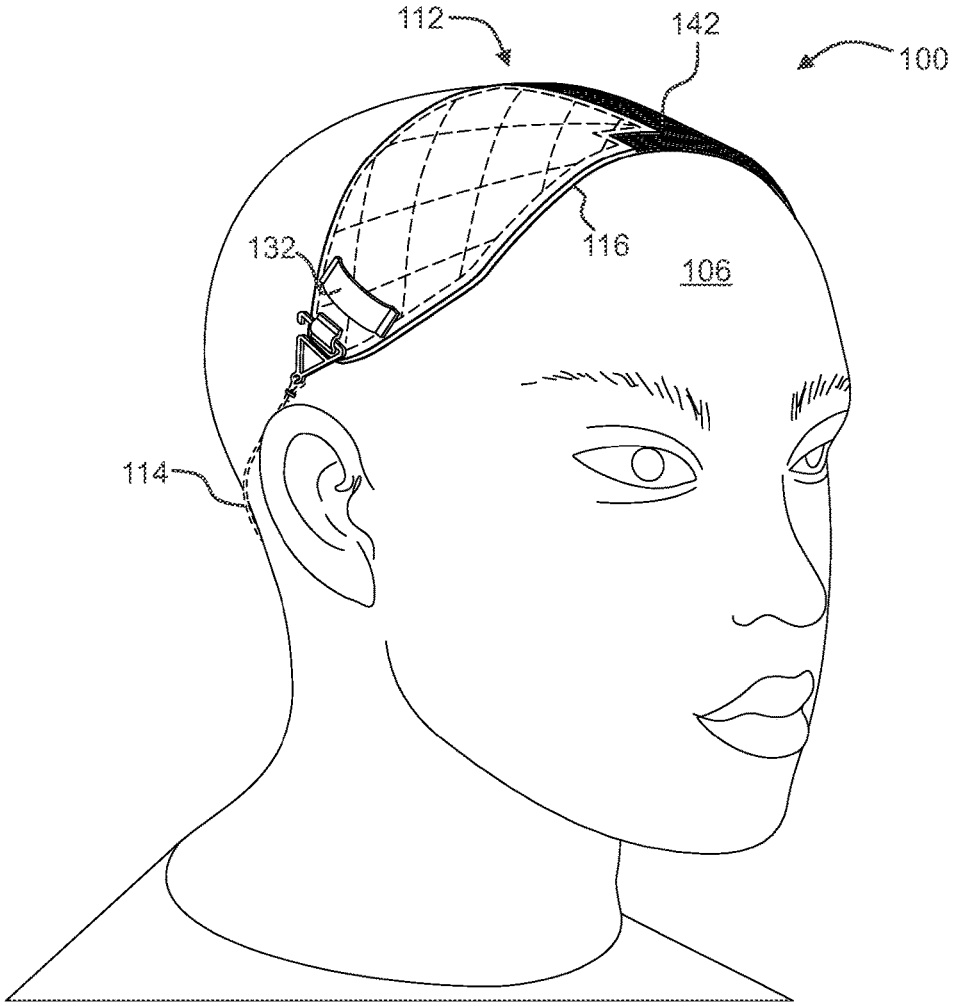
FIG. 19 is a diagrammatic perspective view of an example topper hairpiece interface apparatus comprising the example hairpiece engagement element of FIG. 10, but wherein the apparatus is shown secured to the head of a wearer.
Figure 20:
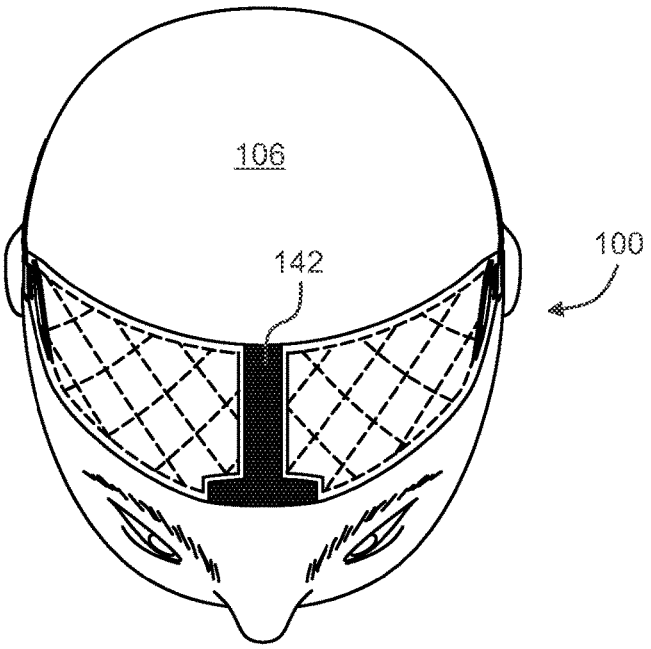
FIG. 20 is a diagrammatic top view of the apparatus and wearer of FIG. 19.
Figure 21:
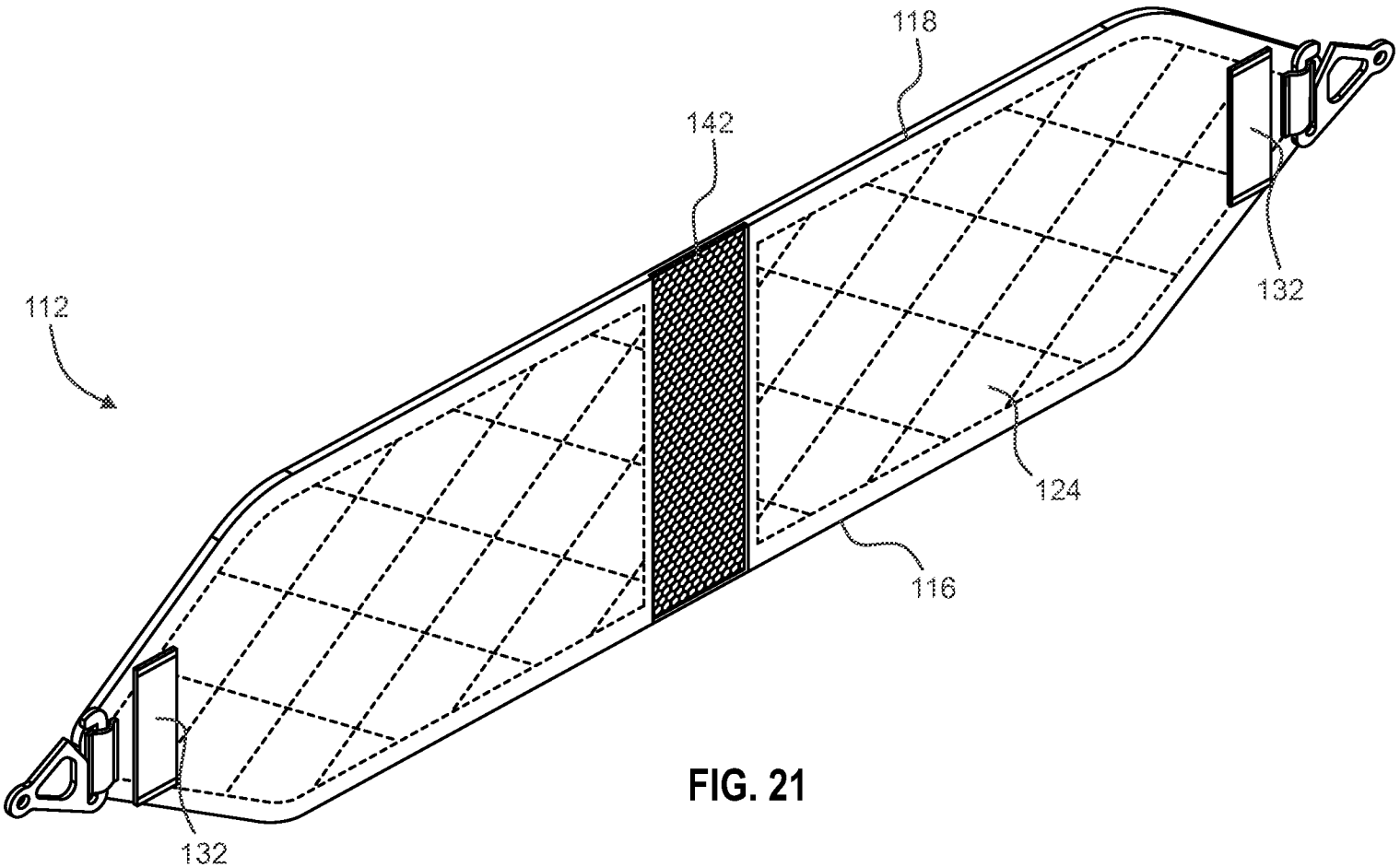
FIG. 21 is a diagrammatic perspective view of a third example hairpiece engagement element for a topper hairpiece interface apparatus in accordance with the present disclosure.
Figure 22:
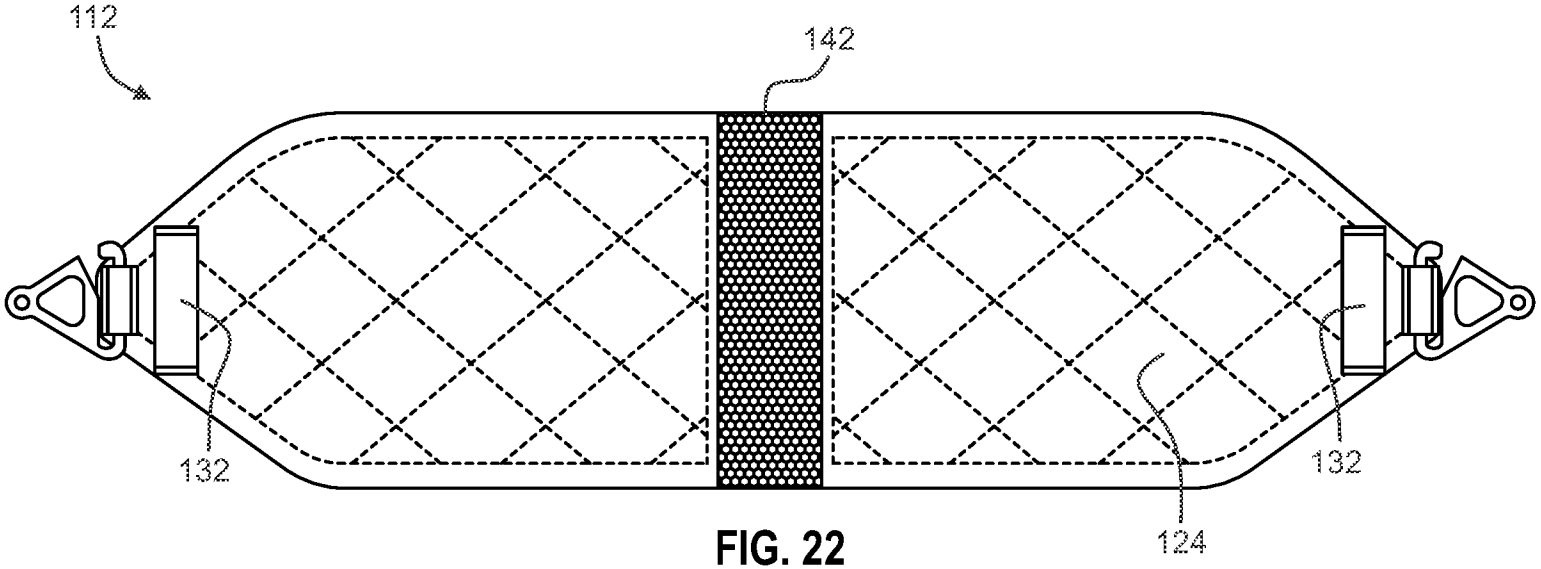
FIG. 22 is a diagrammatic top plan view of the example hairpiece engagement element in FIG. 21.
Figure 23:
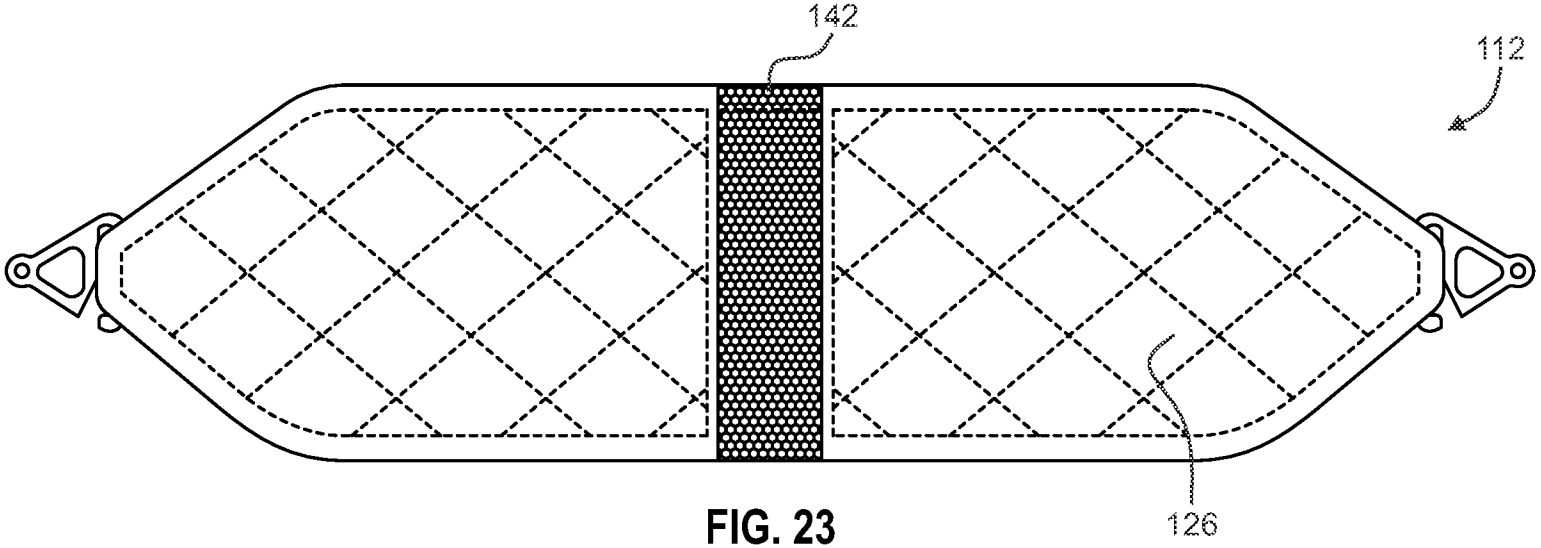
FIG. 23 is a diagrammatic bottom plan view of the example hairpiece engagement element in FIG. 21.
Figure 24:
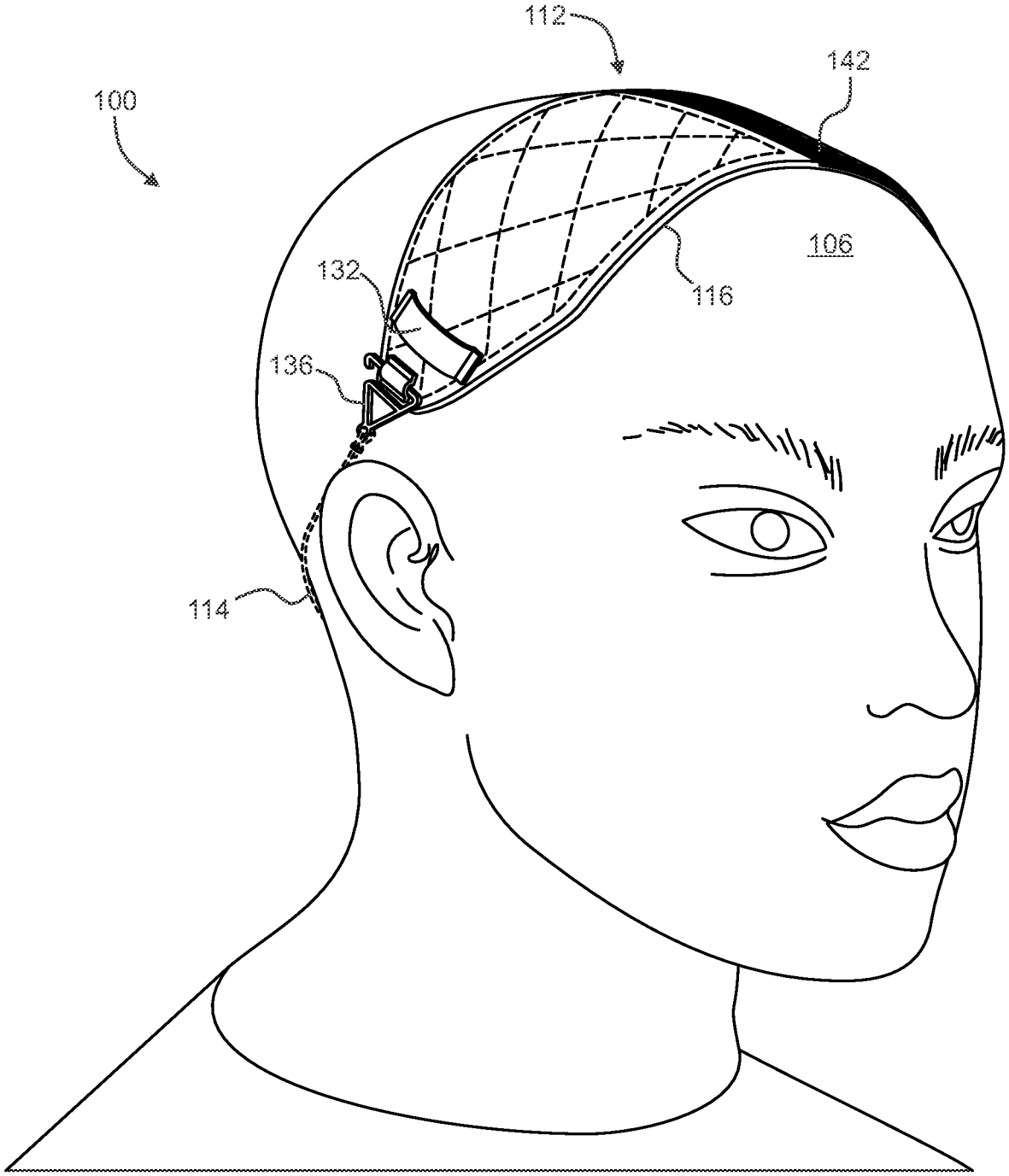
FIG. 24 is a diagrammatic perspective view of an example topper hairpiece interface apparatus comprising the example hairpiece engagement element of FIG. 21, but wherein the apparatus is shown secured to the head of a wearer.
Figure 25:
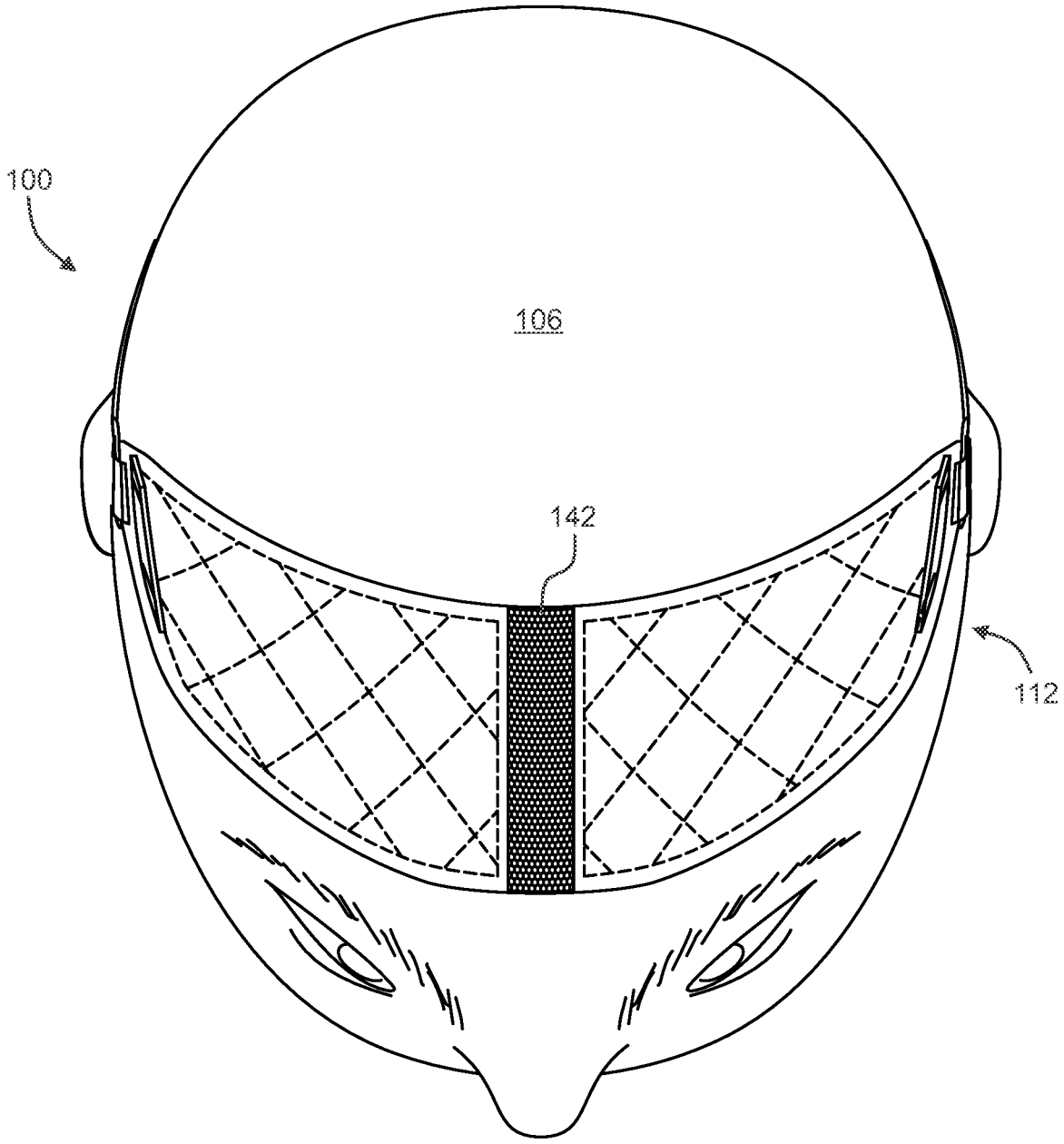
FIG. 25 is a diagrammatic top view of the apparatus and wearer of FIG. 24.
Figure 26:
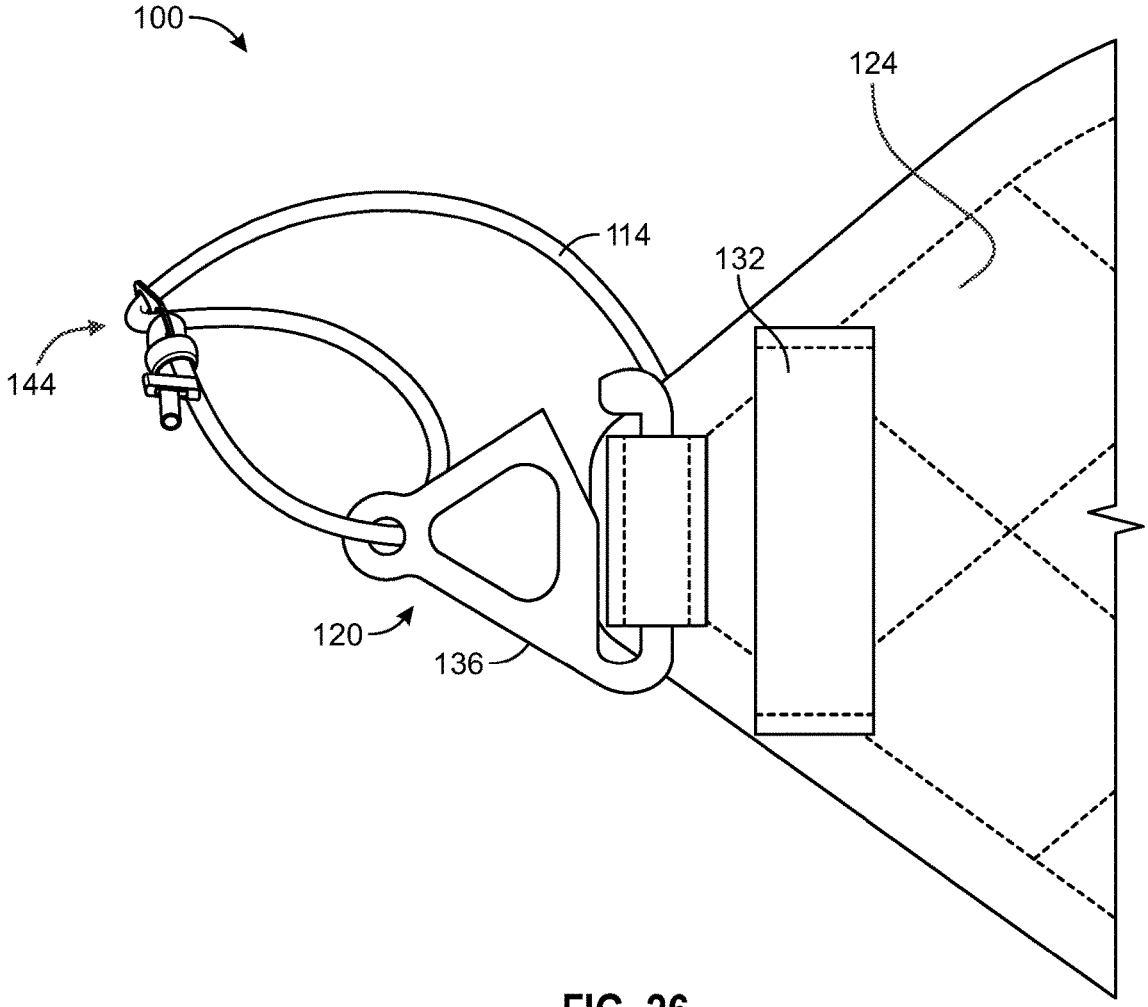
FIG. 26 is a diagrammatic partial view of one example topper hairpiece apparatus in accordance with the present disclosure, illustrating a retention band element connected to the hairpiece engagement element by way of a band connector.
Figure 27:
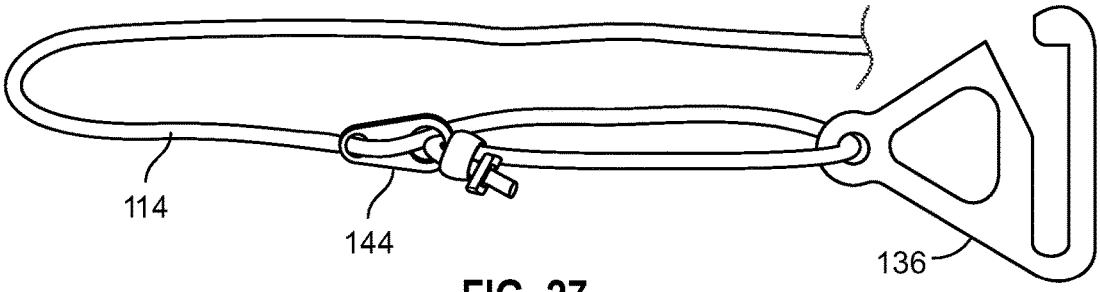
FIG. 27 is a diagrammatic partial view of one example topper hairpiece apparatus in accordance with the present disclosure, illustrating a retention band element having a length adjustment buckle.
Figure 28:
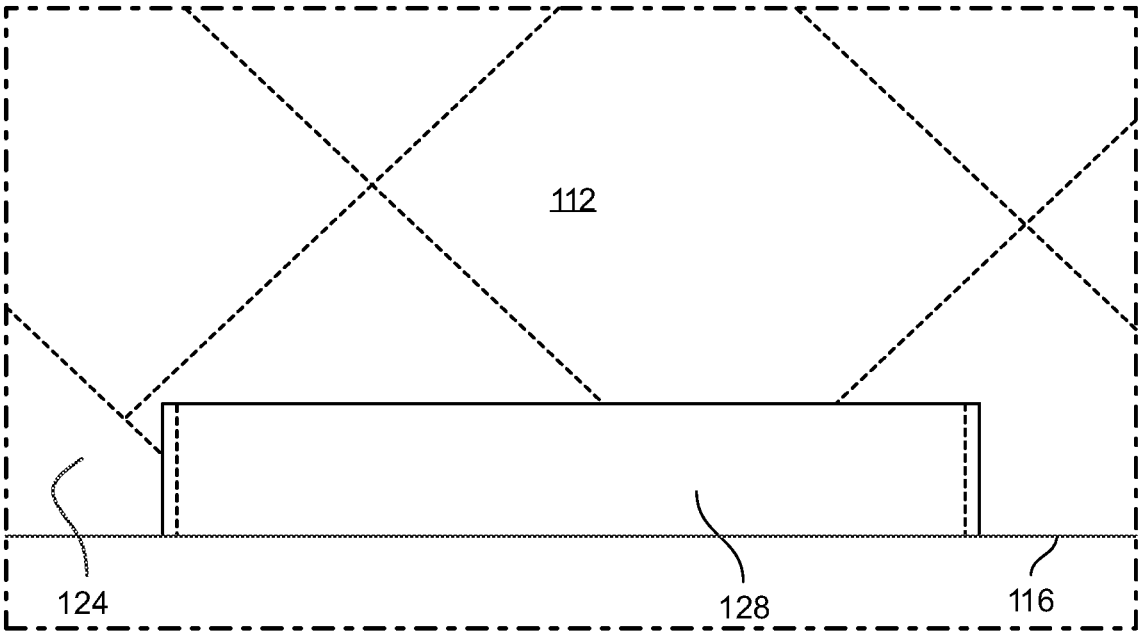
FIG. 28 is a diagrammatic partial view of one example topper hairpiece apparatus in accordance with the present disclosure, illustrating an example of a medial fastener engagement member in the form of a strap or loop affixed to the outboard face of the hairpiece engagement element.
Figure 29:
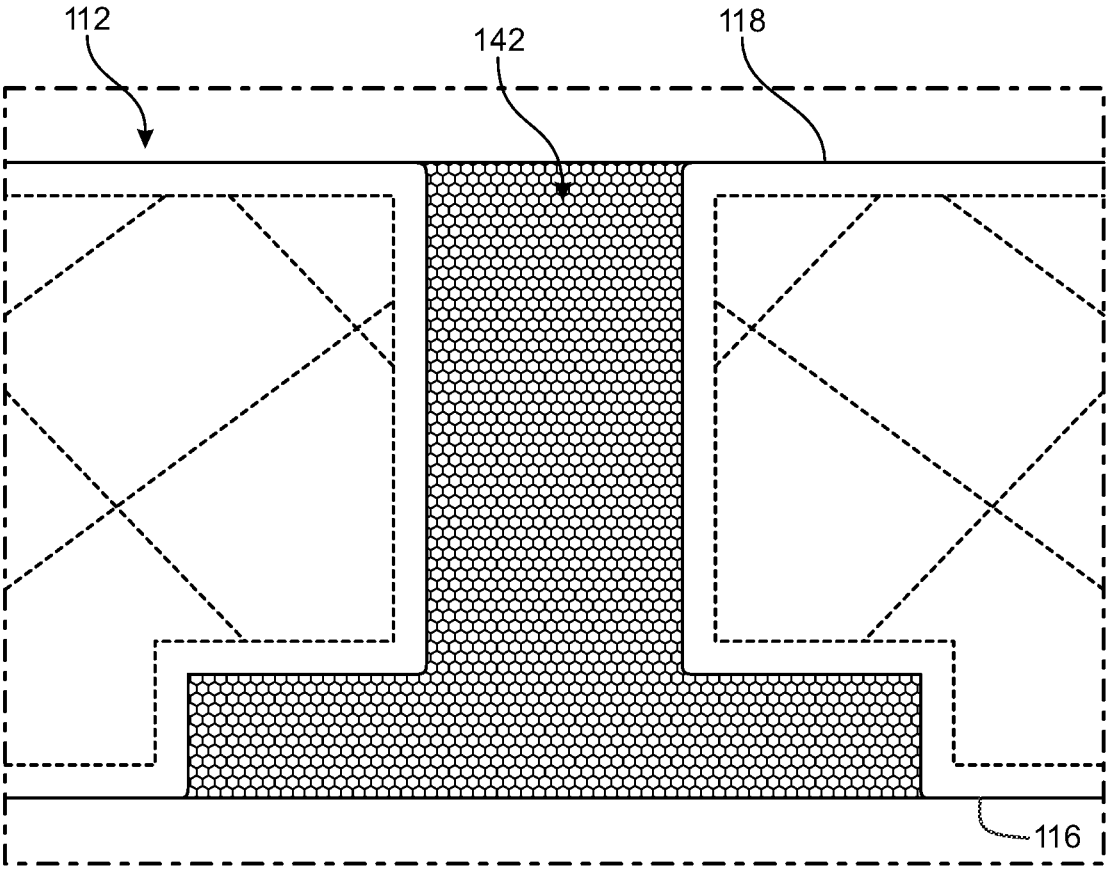
FIG. 29 is a diagrammatic partial view of one example topper hairpiece interface apparatus in accordance with the present disclosure, illustrating an example mesh portion of the hairpiece engagement element, the example mesh portion being transparent and T-shaped.
Figure 30:
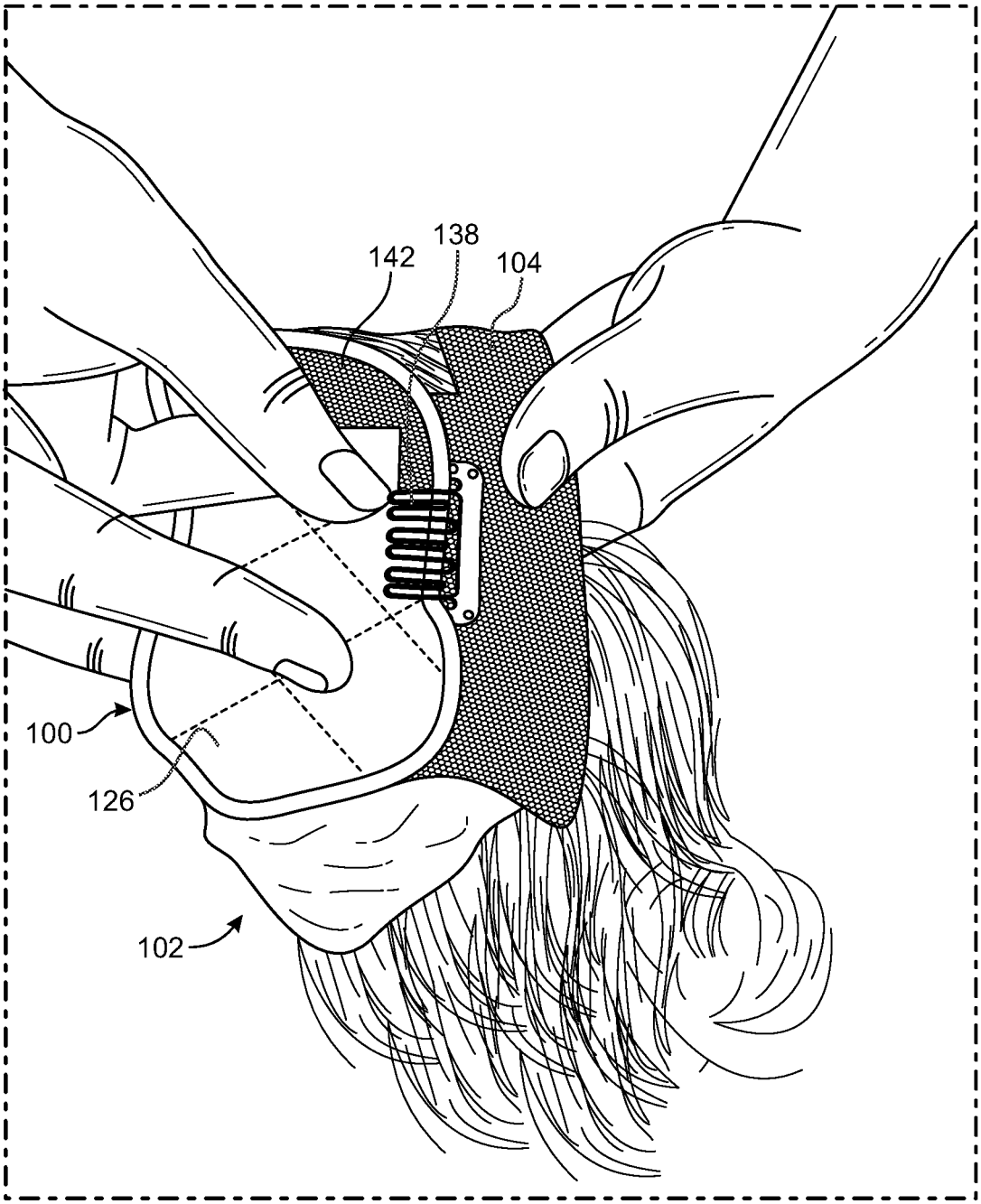
FIG. 30 is a diagrammatic perspective view of a conventional topper hairpiece in the process of being fastened to one example topper hairpiece interface apparatus by way of an extant comb or clip of the topper hairpiece.
Figure 31:
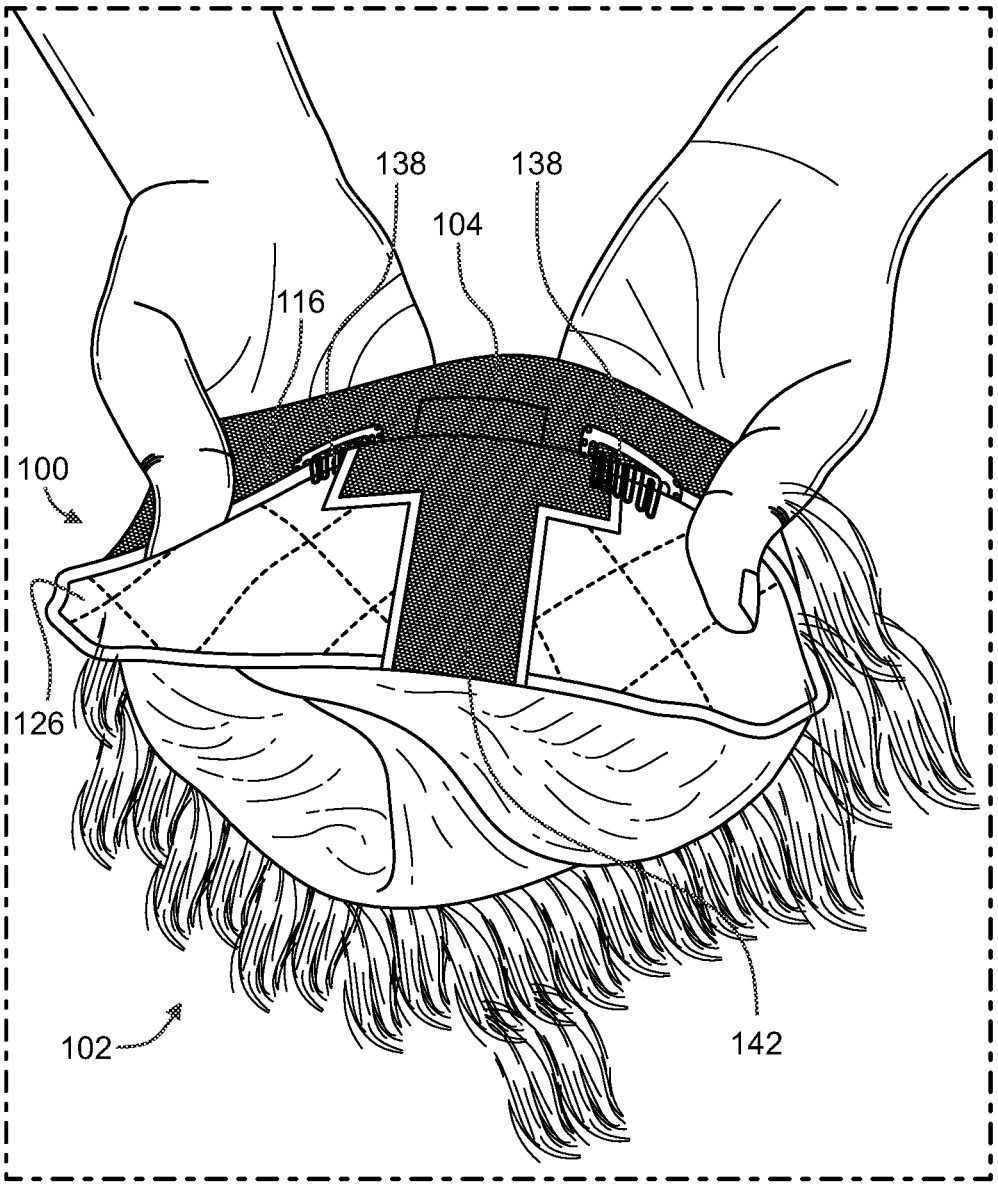
FIG. 31 is a diagrammatic perspective view of a conventional topper hairpiece fastened to one example topper hairpiece interface apparatus by way of extant clips or combs of the topper hairpiece.
Figure 32:
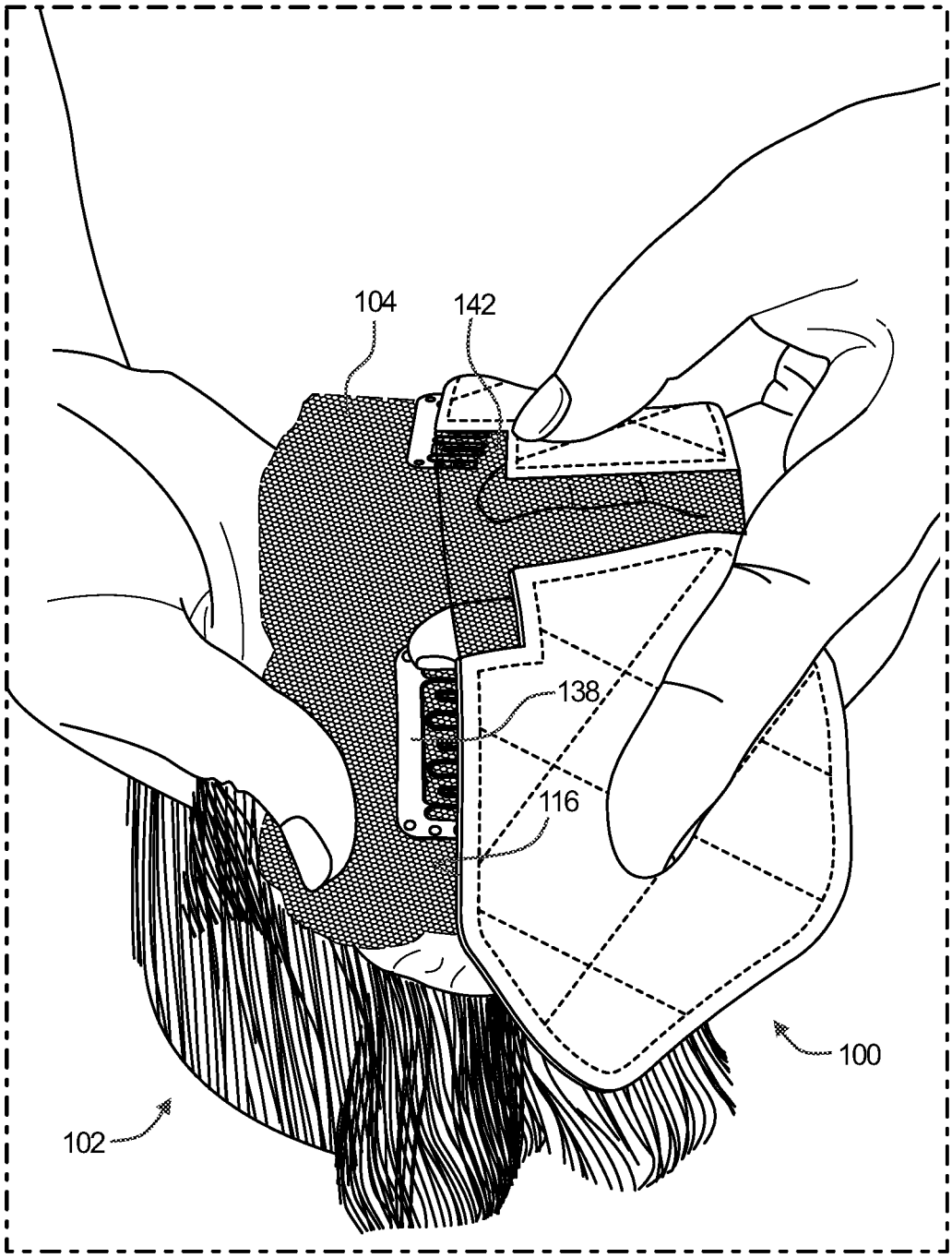
FIG. 32 is a diagrammatic perspective view of a conventional topper hairpiece in the process of being fastened to one example topper hairpiece interface apparatus.
Figure 33:
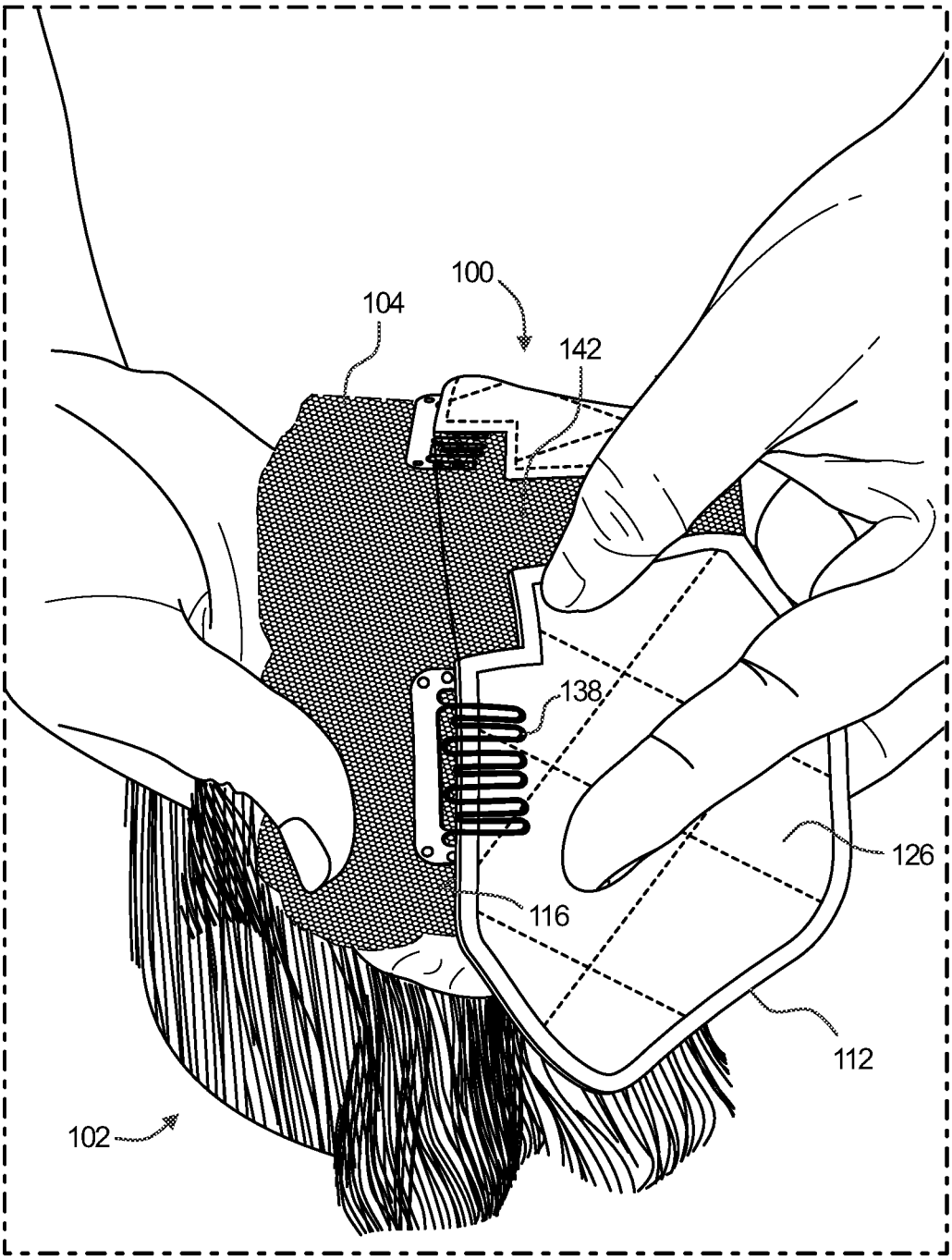
FIG. 33 is a diagrammatic perspective view of a conventional topper hairpiece of FIG. 32 further along in the process of being fastened to one example topper hairpiece interface apparatus, wherein a comb-type or clip-type fastener of the hairpiece is placed in engagement with the forward edge of the hairpiece engagement element of the apparatus.
Figure 34:
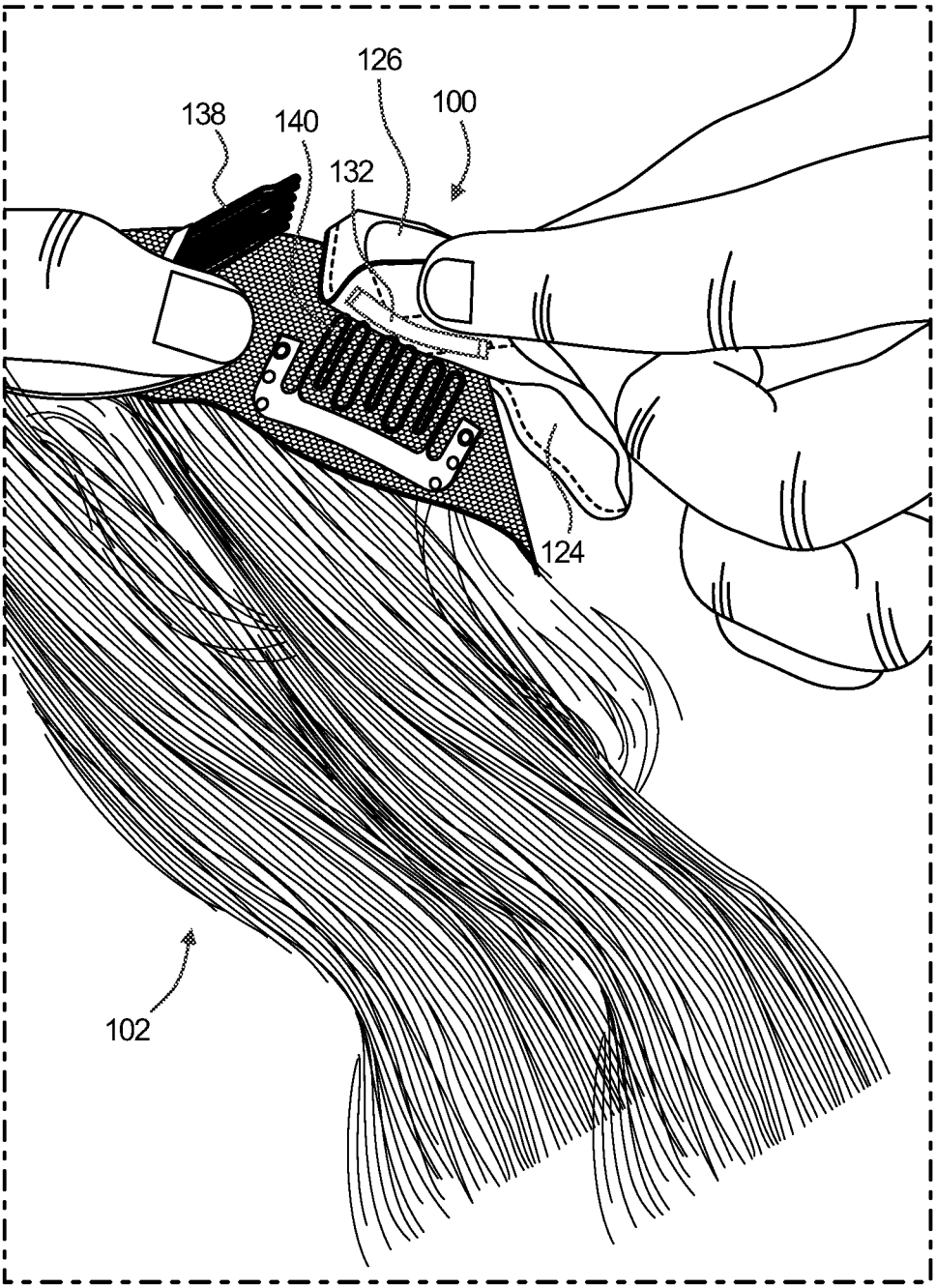
FIG. 34 is a diagrammatic perspective view of a conventional topper hairpiece in the process of being fastened to one example topper hairpiece interface apparatus, wherein a clip-type fastener of the hairpiece is being placed in engagement with a lateral fastener engagement member of the apparatus.
Figure 35:
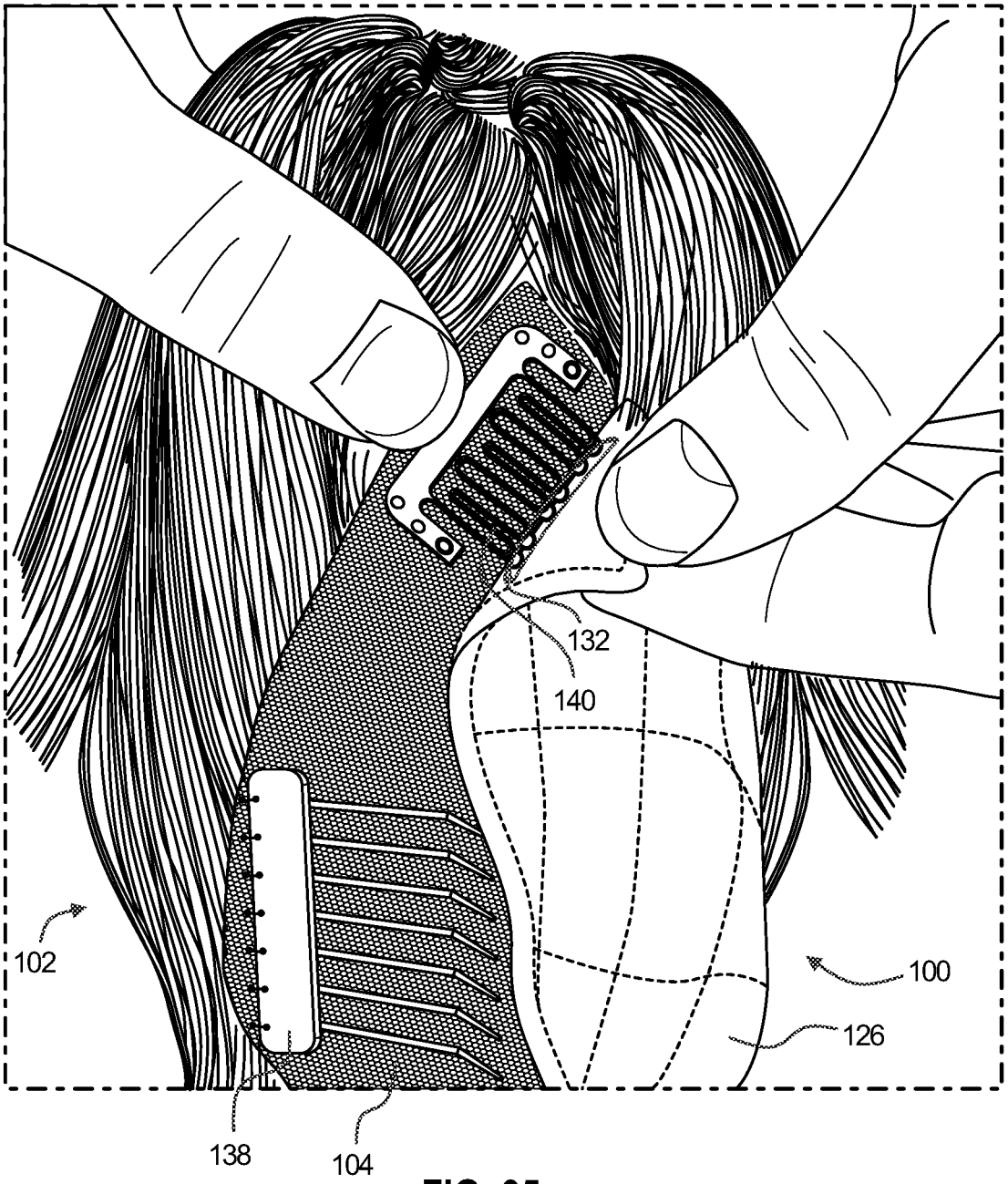
FIG. 35 is a further diagrammatic perspective view of the step shown in FIG. 34.
Figure 36:
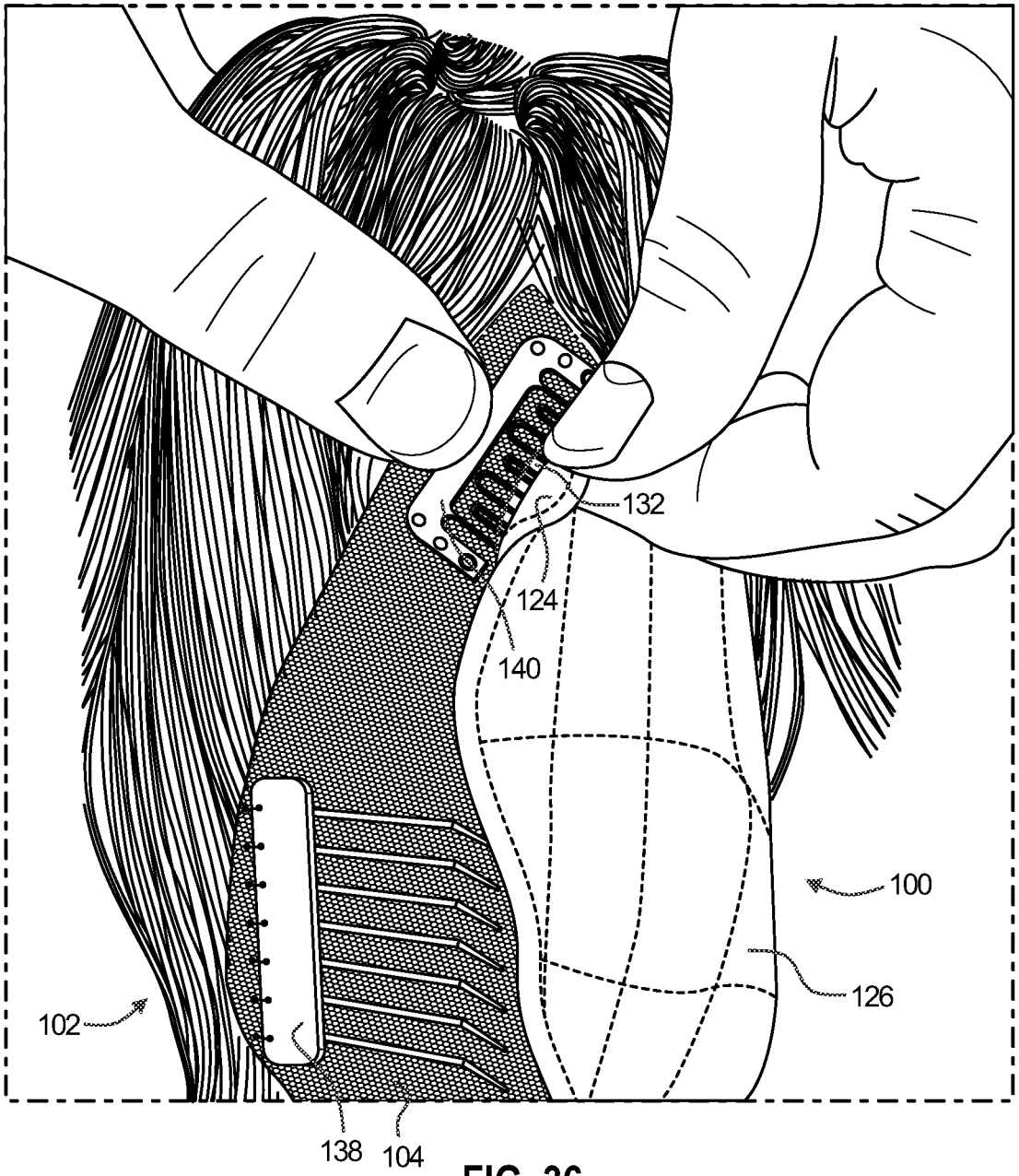
FIG. 36 is a diagrammatic perspective view similar to that of FIG. 35, but wherein the clip-type fastener of the hairpiece is now partially inserted between the lateral fastener engagement member and the outboard face of the hairpiece engagement element.
Figure 37:
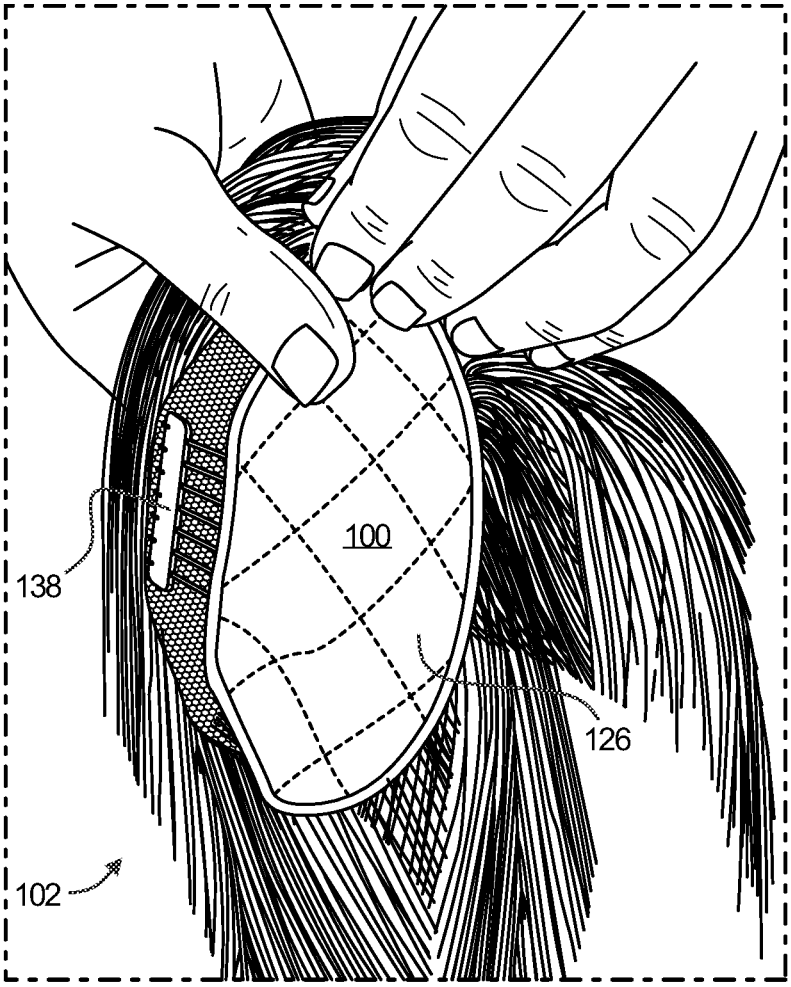
FIG. 37 is a diagrammatic perspective view of the conventional topper hairpiece of FIG. 34 fastened to the hairpiece engagement element by way of the clip-type being inserted between the lateral fastener engagement member and the outboard face of the hairpiece engagement element, whereby the respective hairpiece engagement element is positioned to shield the user's scalp or natural hair from the hairpiece fasteners.
Figure 38:
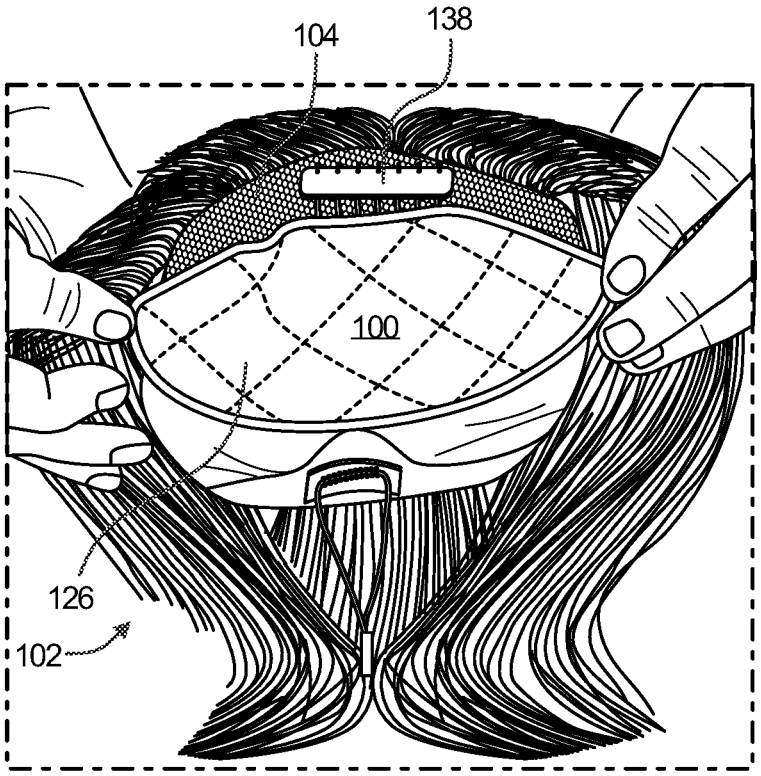
FIG. 38 is a further diagrammatic perspective view of the fully joined topper hairpiece and hairpiece engagement element of FIG. 37.

Referring to FIGS. 7-9, in certain embodiments of the apparatus 100, the hairpiece engagement element 112 may include (a) a medial fastener engagement member 128 configured to be fasteningly engaged by a medial hairpiece fastener 138 of a topper hairpiece 102; and (b) a pair of lateral fastener engagement members, each being configured to be fasteningly engaged by a respective lateral hairpiece fastener 140 of a topper hairpiece 102. The medial fastener engagement member and the lateral fastener engagement members may be disposed on the outboard face. Referring to FIG. 2, the medial fastener engagement member 128 may be proximate the forward edge 116, and the lateral fastener engagement members 132 may be proximate respective said lateral sides (120, 122).

Moreover, referring again to FIG. 2, the medial fastener engagement member 128 may define a medial fastener engagement axis 130 along which a said medial hairpiece fastener 138 is movable into and out of said fastening engagement with the medial fastener engagement member 128. Similarly, each of the lateral fastener engagement members 132 may define a respective lateral fastener engagement axis 134 along which a corresponding said lateral hairpiece fastener 140 is movable into and out of said fastening engagement with the lateral fastener engagement member 132. The lateral fastener engagement axes 134 may each be perpendicular to the medial fastener engagement axis 130.

Figure 8A:
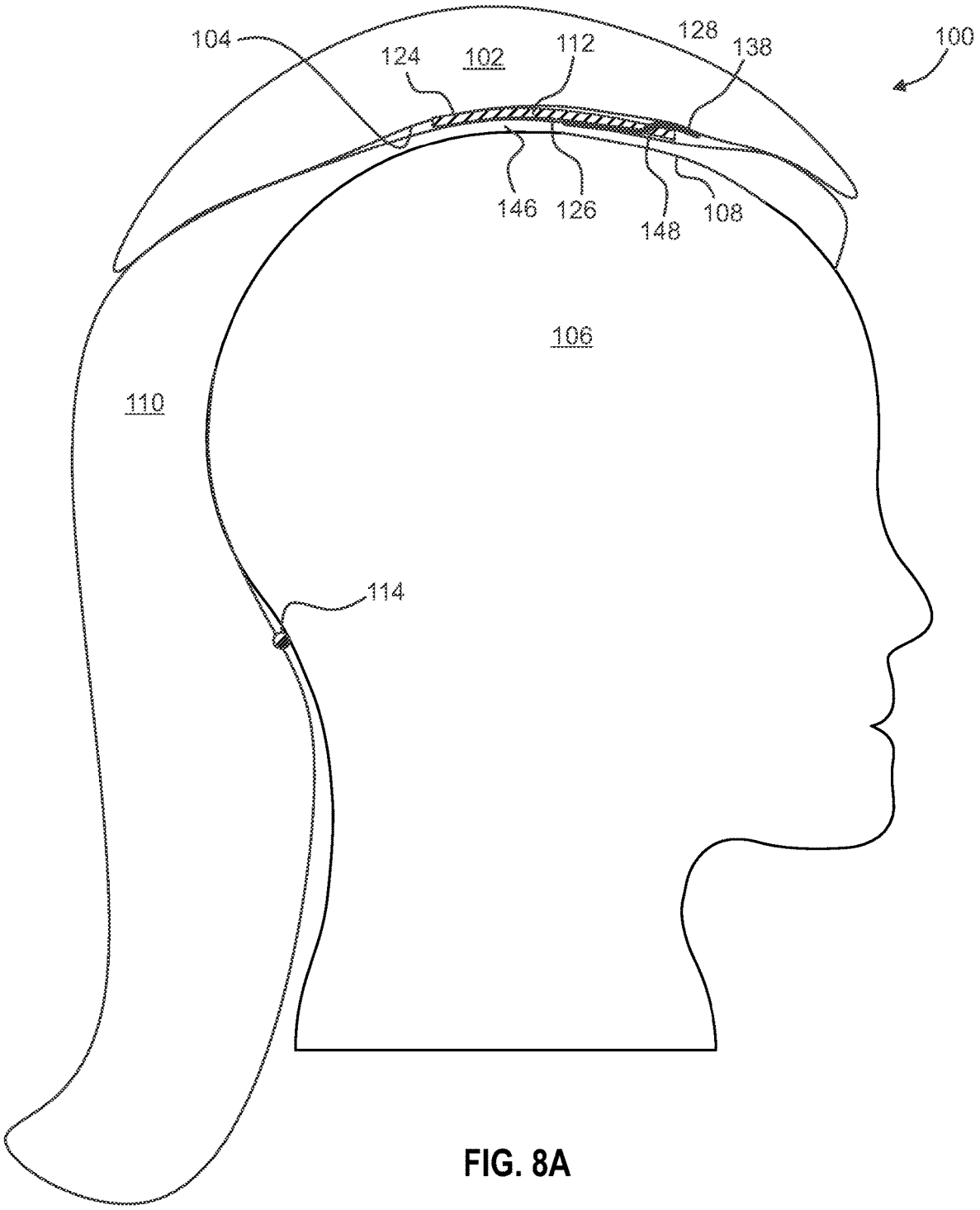
FIG. 8A is a diagrammatic cross-sectional view similar to that of FIG. 8, but showing a third method of affixing the topper hairpiece to the hairpiece engagement element, wherein a comb or clip of the hairpiece foundation extends through a corresponding slit in the hairpiece engagement element.

Referring to FIG. 8A, in particular embodiments of the apparatus 100, the hairpiece engagement element 112 may include at least one fastener engagement slit 148 configured to be fasteningly engaged by a hairpiece fastener 138 of a topper hairpiece 102.

Referring to FIGS. 16-25, in certain embodiments of a topper hairpiece interface apparatus 100, the hairpiece engagement element 112 may include a mesh portion 142. The mesh portion may preferably be transparent. Moreover, the mesh portion 142 may extend from the forward edge 116 to the rearward edge 118. Furthermore, as illustrated for example in FIGS. 16-20, the mesh portion may be T-shaped.

In certain implementations of a topper hairpiece interface apparatus 100, the foundation 104 of the topper hairpiece 102 may be glued or taped to the hairpiece engagement element 112.

Referring to FIGS. 7-9, various embodiments of the topper hairpiece interface apparatus 100 discussed herein facilitate securement of a topper hairpiece 102 to the head 106 of a wearer over an affected area 146 of the wearer's natural hair 110 without subjecting the wearer's remaining natural hair 110 to damage from clips and combs, and without causing irritation of the scalp often resulting from the use of adhesives and tapes. Accordingly, the wearer is able to enjoy improved hair fullness over the affect area without the damage and discomfort caused by convention topper-securement expedients. A transparent retention band element 114 also averts uncomfortable and bunching of a conventional wig grip band extending around the back of the head.

The following listing matches certain terminology used within this disclosure with corresponding reference numbers used in the non-limiting examples illustrated in the several figures.

100 topper hairpiece interface apparatus
102 topper hairpiece (including a foundation and strands of hair attached thereto)
104 foundation (of topper hairpiece)
106 head of wearer
108 scalp of a wearer
110 natural hair of wearer
112 hairpiece engagement element (e.g., flexible; e.g., comprised of velvet or velour)
114 retention band element (e.g., transparent; e.g., polymer filament)
116 forward edge
118 rearward edge
120 first lateral side
122 second lateral side
124 outboard face
126 inboard face
128 medial fastener engagement member (e.g., strap)
130 medial fastener engagement axis
132 lateral fastener engagement member (e.g., strap)
134 lateral fastener engagement axis
136 band connector (e.g., slidably engageable with hairpiece engagement element)
138 medial hairpiece fastener (e.g., comb or clip)
140 lateral hairpiece fastener (e.g., comb or clip)
142 mesh portion (e.g., transparent; e.g., lace)
144 length adjustment buckle (to adjust length of the retention band element)
146 affected area (where the wearer's natural hair is thinning or absent)
148 fastener engagement slit (e.g., for receiving hairpiece fastener)
150 width While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A topper hairpiece interface apparatus for facilitating securement of a topper hairpiece having a foundation and topper hair strands to a head of a wearer, the apparatus comprising:

a hairpiece engagement element being flexible and having a first lateral side, a second lateral side opposite thereof, an outboard face and an inboard face; and a retention band element connected to the first and second lateral sides;

wherein (a) the apparatus is configured to encircle the head of the wearer with the hairpiece engagement element being disposed between the foundation and the head of the wearer;

(b) the foundation is a piece of porous material sufficiently sized to extend across most or all of the outboard face; and (c) the topper hair strands are affixed to the foundation;

wherein the hairpiece engagement element includes (a) a medial fastener engagement member configured to be fasteningly engaged by a medial hairpiece fastener of a topper hairpiece;

(b) a pair of lateral fastener engagement members, each being configured to be fasteningly engaged by a respective lateral hairpiece fastener of the topper hairpiece; and (c) the medial fastener engagement member and the lateral fastener engagement members are disposed on the outboard face;

wherein (a) the medial fastener engagement member defines a medial fastener engagement axis along which said medial hairpiece fastener is movable into and out of said fastening engagement with the medial fastener engagement member;

(b) each of the lateral fastener engagement members defines a respective lateral fastener engagement axis along which a corresponding said lateral hairpiece fastener is movable into and out of said fastening engagement with the lateral fastener engagement member; and (c) the lateral fastener engagement axes are each perpendicular to the medial fastener engagement axis; and wherein (a) the medial fastener engagement member is in a form of a strap elongated in a direction orthogonal to the medial fastener engagement axis; and (b) each of the lateral fastener engagement members is in a form of a strap elongated in a direction orthogonal to its lateral fastener engagement axis.

2. The topper hairpiece interface apparatus as defined in claim 1, wherein the retention band element is comprised of a transparent material.

3. The topper hairpiece interface apparatus as defined in claim 2, wherein the retention band element is a polymer filament.

4. The topper hairpiece interface apparatus as defined in claim 2, wherein the retention band element is elastic.

5. The topper hairpiece interface apparatus as defined in claim 2, wherein the retention band element includes a length-adjustment buckle configured to enable a user to adjust a length of the retention band element.

6. The topper hairpiece interface apparatus as defined in claim 1, wherein the retention band element is connected to the first and second lateral sides by way of a respective pair of band connectors non-destructively removable from the first and second lateral sides.

7. The topper hairpiece interface apparatus as defined in claim 6, wherein the band connectors are comprised of a metal.

8. The topper hairpiece interface apparatus as defined in claim 1, wherein the hairpiece engagement element is comprised of a fabric.

9. The topper hairpiece interface apparatus as defined in claim 1, wherein the hairpiece engagement element is comprised of a velvet or velour.

10. The topper hairpiece interface apparatus as defined in claim 1, wherein the hairpiece engagement element includes a forward edge, a rearward edge opposite thereof and a width defined between the forward edge and the rearward edge, the width being greater toward the center of hairpiece engagement element than toward the first and second lateral sides.

11. The topper hairpiece interface apparatus as defined in claim 1, wherein the hairpiece engagement element includes at least one fastener engagement member configured to be fasteningly engaged by a hairpiece fastener of a topper hairpiece.

12. The topper hairpiece interface apparatus as defined in claim 11, wherein the hairpiece fastener is a comb-type fastener or a clip-type fastener.

13. The topper hairpiece interface apparatus as defined in claim 1, wherein (a) the hairpiece engagement element includes a forward edge and a rearward edge opposite thereof;

(b) the medial fastener engagement member is proximate the forward edge; and (c) the lateral fastener engagement members are proximate respective said lateral sides.

14. The topper hairpiece interface apparatus as defined in claim 1, wherein the hairpiece engagement element includes at least one fastener engagement slit configured to be fasteningly engaged by a hairpiece fastener of a topper hairpiece.

15. The topper hairpiece interface apparatus as defined in claim 1, wherein the hairpiece engagement element includes a mesh portion, the mesh portion being transparent.

16. The topper hairpiece interface apparatus as defined in claim 15, wherein (a) the hairpiece engagement element includes a forward edge, a rearward edge opposite thereof; and (b) the mesh portion extends from the forward edge to the rearward edge.

17. The topper hairpiece interface apparatus as defined in claim 15, wherein the mesh portion is T-shaped.

* * * * *